US011541670B2

(12) United States Patent
Ishimoto et al.

(10) Patent No.: US 11,541,670 B2
(45) Date of Patent: Jan. 3, 2023

(54) RIBBON CARTRIDGE

(71) Applicant: SEIKO EPSON CORPORATION, Tokyo (JP)

(72) Inventors: Akio Ishimoto, Shiojiri (JP); Taishi Sasaki, Matsumoto (JP)

(73) Assignee: SEIKO EPSON CORPORATION, Tokyo (JP)

( * ) Notice: Subject to any disclaimer, the term of this patent is extended or adjusted under 35 U.S.C. 154(b) by 0 days.

(21) Appl. No.: 17/568,424

(22) Filed: Jan. 4, 2022

(65) Prior Publication Data

US 2022/0126595 A1 Apr. 28, 2022

Related U.S. Application Data

(63) Continuation of application No. 16/980,457, filed as application No. PCT/JP2019/013905 on Mar. 28, 2019, now Pat. No. 11,298,956.

(30) Foreign Application Priority Data

Mar. 29, 2018 (JP) ..... JP2018-063685
Dec. 26, 2018 (JP) ..... JP2018-243215

(51) Int. Cl.
*B41J 2/325* (2006.01)
*B41J 17/32* (2006.01)
*B41J 3/62* (2006.01)

(52) U.S. Cl.
CPC ..... *B41J 2/325* (2013.01); *B41J 17/32* (2013.01); *B41J 3/62* (2013.01)

(58) Field of Classification Search
CPC ..... B41J 2/325; B41J 17/32; B41J 3/62; B41J 3/4075; B41J 32/00; B41J 35/04
See application file for complete search history.

(56) References Cited

U.S. PATENT DOCUMENTS 6,485,206 B1 11/2002 Takahashi
2010/0123282 A1* 5/2010 Miyakoshi ..... H04N 1/00602 271/3.19

(Continued)

FOREIGN PATENT DOCUMENTS

EP 3778245 A1 2/2021
EP 3778246 A1 2/2021

(Continued)

OTHER PUBLICATIONS

May 28, 2019 International Search Report issued in International Patent Application No. PCT/JP2019/013905.

*Primary Examiner* — Kristal Feggins
(74) *Attorney, Agent, or Firm* — Oliff PLC

(57) ABSTRACT

A ribbon cartridge includes: a winding-side cylinder part that guides an ink ribbon and into which a winding shaft is inserted when the ribbon cartridge is installed in a cartridge installation part; a first ribbon guide that guides the ink ribbon at a position on a downstream side of the winding-side cylinder part in a feeding direction of the ink ribbon; and a second ribbon guide that guides the ink ribbon at a position on the downstream side of the ribbon guide in the feeding direction. The first ribbon guide is on an inner side of the second ribbon cartridge with respect to a guide imaginary line connecting the winding-side cylinder part and the second ribbon guide to each other when seen from a front side of the ribbon cartridge in an installation direction.

9 Claims, 12 Drawing Sheets

(56) References Cited

U.S. PATENT DOCUMENTS

| | | | | |
|---|---|---|---|---|
| 2011/0008090 | A1* | 1/2011 | Yamaguchi | B41J 17/32 400/613 |
| 2013/0021622 | A1* | 1/2013 | Yamaguchi | B41J 11/663 358/1.6 |
| 2020/0207131 | A1 | 7/2020 | Ishimoto et al. | |
| 2021/0138813 | A1 | 5/2021 | Ishimoto et al. | |

FOREIGN PATENT DOCUMENTS

| | | | |
|---|---|---|---|
| JP | 2001-150777 | A | 6/2001 |
| JP | 2005-186567 | A | 7/2005 |
| JP | 2011-046042 | A | 3/2011 |
| JP | 2017-024324 | A | 2/2017 |
| WO | 2006/123865 | A1 | 11/2006 |
| WO | 2019/187973 | A1 | 10/2019 |
| WO | 2019/189710 | A1 | 10/2019 |

* cited by examiner

RIBBON CARTRIDGE

CROSS-REFERENCE TO RELATED APPLICATIONS

This is a Continuation of U.S. application Ser. No. 16/980,457 filed Sep. 14, 2020, which in turn is a National Stage Application of PCT/JP2019/013905 filed Mar. 28, 2019, which claims priority to Japanese Patent Application No. 2018-063685 filed Mar. 29, 2018 and Japanese Patent Application No. 2018-243215 filed Dec. 26, 2018. The disclosure of the prior applications is hereby incorporated by reference herein in its entirety.

TECHNICAL FIELD

The present invention relates to a ribbon cartridge accommodating an ink ribbon.

BACKGROUND ART

As disclosed in Patent Document 1, there has been known a ribbon cassette that is installed in a printing device including a cassette installation part in which a tape cassette is installed and a ribbon installation part in which the ribbon cassette is installed.

[Patent Document 1] JP-A-2017-024324

DISCLOSURE OF THE INVENTION

A printing device disclosed in Patent Document 1 includes the two printing units of a tape printing unit and a tube printing unit. Therefore, the printing device is upsized, and its manufacturing cost is increased. The inventor of the present invention has hit upon the idea of making a part of a first cartridge installation part and a part of a second cartridge installation part common in a printing device including the first cartridge installation part in which a first ribbon cartridge is installed and a second cartridge installation part in which a second ribbon cartridge having a greater ribbon accommodation amount than that of the first ribbon cartridge is installed. In such a printing device, a first winding shaft that is inserted into a first winding core accommodated in the first ribbon cartridge is provided in an overlap region in which the first cartridge installation part and the second cartridge installation part overlap each other. In addition, a winding-side cylinder part that guides a second ink ribbon and into which the first winding shaft is inserted so as to be prevented from interfering with the second cartridge installation part when the second ribbon cartridge is installed in the second cartridge installation part is provided in the second ribbon cartridge. Further, a ribbon guide is provided on the downstream side of the winding-side cylinder part in the feeding direction of the second ink ribbon. According to the configuration, the second ink ribbon is fed along a guide imaginary line connecting the winding-side cylinder part and a ribbon guide to each other. However, a further improvement is needed to downsize the second ribbon cartridge.

The present invention has an object of optimizing a ribbon conveyance path and providing a downsized ribbon cartridge.

A ribbon cartridge of the present invention is a ribbon cartridge that is a second ribbon cartridge installed in a printing device including a first cartridge installation part in which a first ribbon cartridge accommodating a first winding core on which a first ink ribbon is wound is installed, a second cartridge installation part in which the second ribbon cartridge accommodating a second ink ribbon is installed, and a first winding shaft that is provided in an overlap region of the first cartridge installation part and the second cartridge installation part and inserted into the first winding core when the first ribbon cartridge is installed in the first cartridge installation part, the ribbon cartridge including: a winding-side cylinder part that guides the second ink ribbon and into which the first winding shaft is inserted when the second ribbon cartridge is installed in the second cartridge installation part; a first ribbon guide that guides the second ink ribbon at a position on a downstream side of the winding-side cylinder part in a feeding direction of the second ink ribbon; and a second ribbon guide that guides the second ink ribbon at a position on a downstream side of the first ribbon guide in the feeding direction, wherein the first ribbon guide is provided on an inner side of the second ribbon cartridge with respect to a guide imaginary line connecting the winding-side cylinder part and the second ribbon guide to each other when seen from a front side of the second ribbon cartridge in an installation direction.

BEST MODES FOR CARRYING OUT THE INVENTION

Hereinafter, a ribbon cartridge 200 that is an embodiment of the "second ribbon cartridge" of the present invention will be described together with a tape printing device P in which the ribbon cartridge 200 is installed with reference to the accompanying drawings. The tape printing device P is an example of the "printing device" of the present invention. Note that the following drawings show an XYZ orthogonal coordinate system to make the arrangement relationships between respective parts clear but the present invention is not limited to the XYZ orthogonal coordinate system in any way as a matter of course.

[Tape Printing Device]

Figure 1:
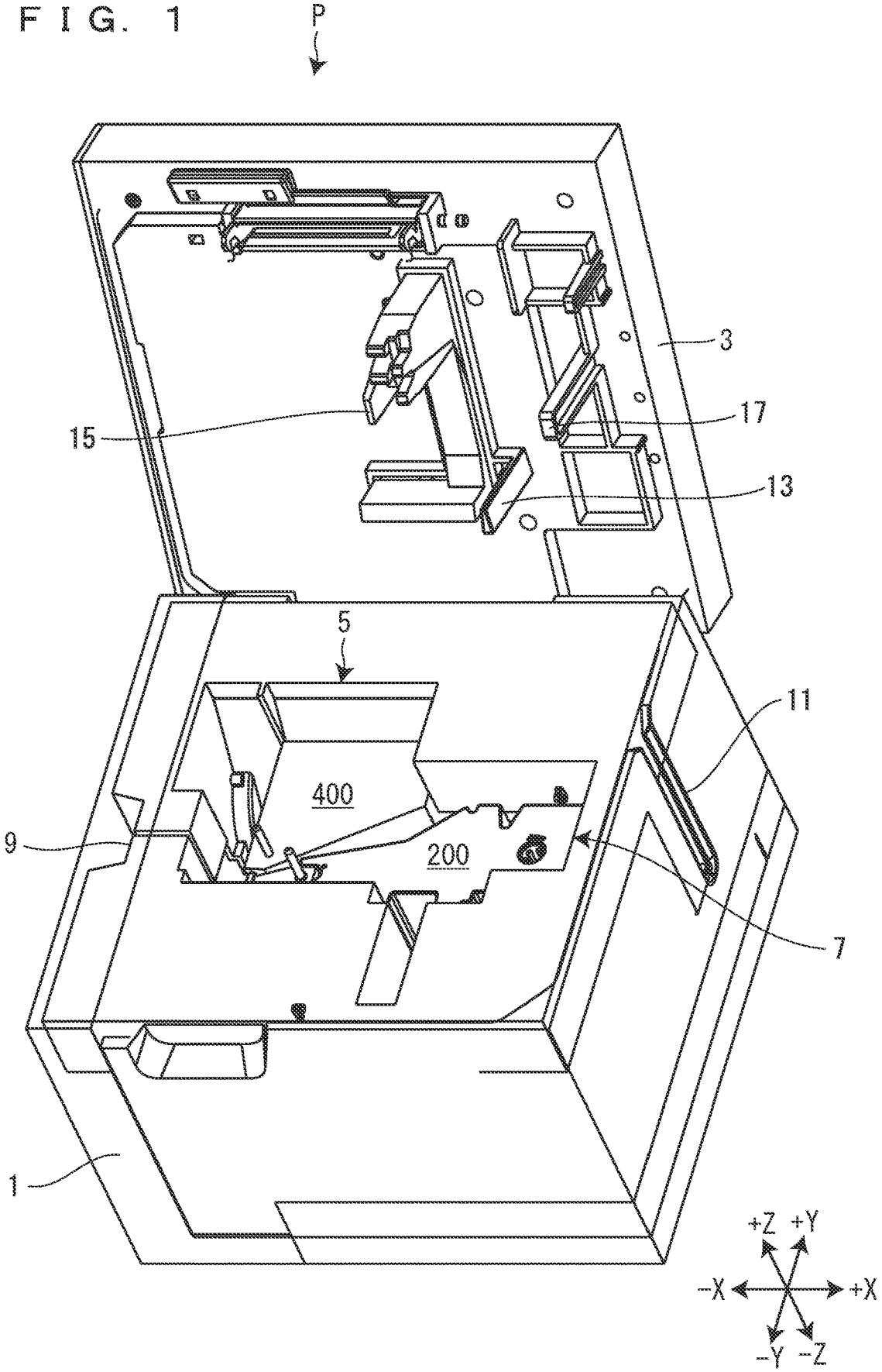
FIG. 1 is a perspective view of a tape printing device in a state in which a ribbon cartridge and a tape guide according to an embodiment of the present invention are installed.
Figure 2:
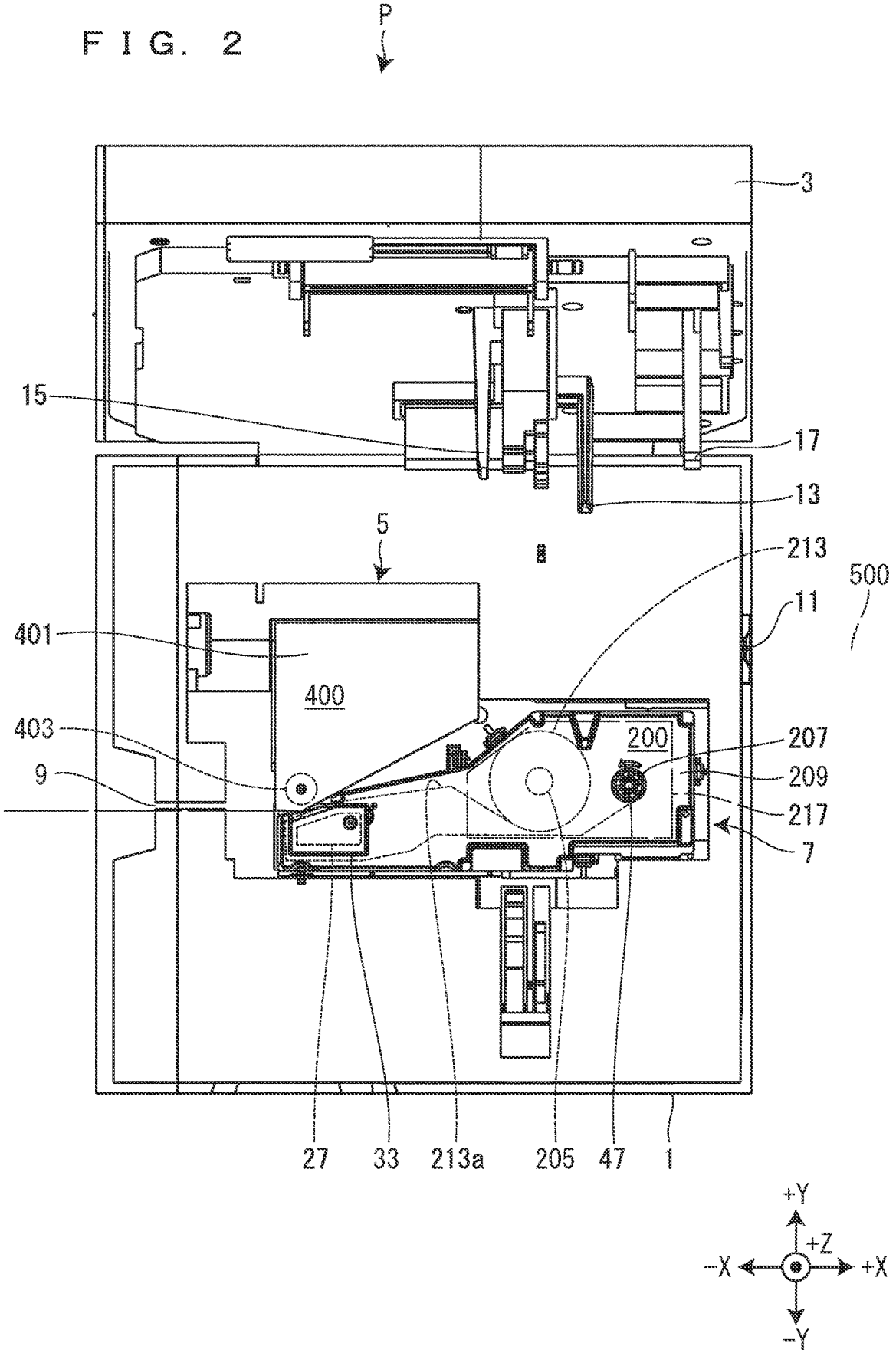
FIG. 2 is a view of the tape printing device when seen from a front side in an installation direction in a state in which the ribbon cartridge and the tape guide are installed.
Figure 3:
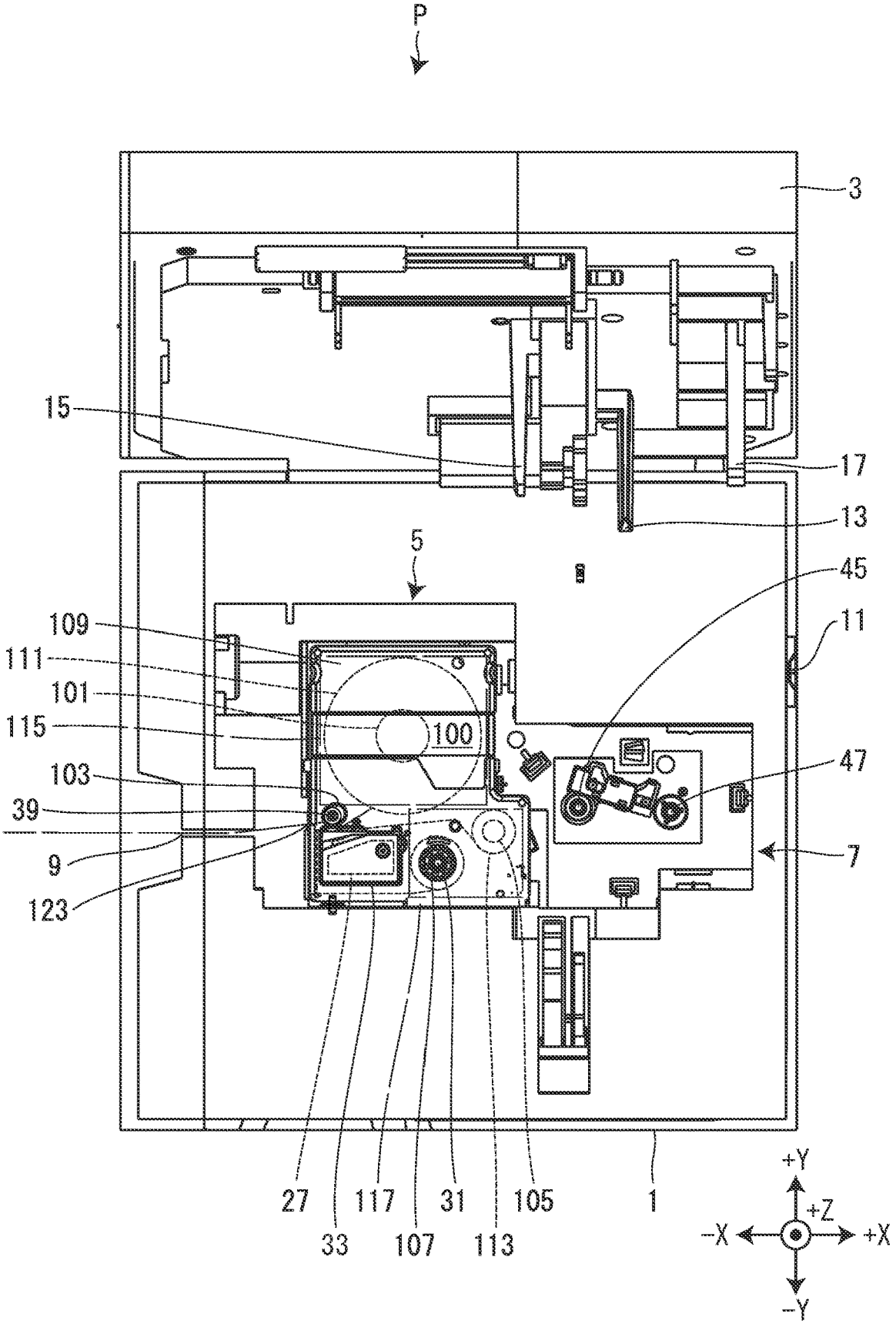
FIG. 3 is a view of the tape printing device when seen from the front side in the installation direction in a state in which a tape cartridge is installed.

The tape printing device P will be described on the basis of FIGS. 1 to 4. In the tape printing device P, a tape cartridge 100, a ribbon cartridge 200, and a tape guide 400 are detachably installed. In the tape cartridge 100, a first tape 111 and a first ink ribbon 113 are accommodated. The tape cartridge 100 is an example of the "first ribbon cartridge" of the present invention. In the ribbon cartridge 200, a second ink ribbon 213 is accommodated. The ribbon cartridge 200 is an example of the "second ribbon cartridge" of the present invention. Further, a tape introduction port 11 for introducing a second tape 500 from the outside of the tape printing device P is provided in the tape printing device P. The tape guide 400 guides the second tape 500 introduced from the tape introduction port 11. The tape printing device P can perform first tape printing to perform printing on the first tape 111 in a state in which the tape cartridge 100 is installed as shown in FIG. 3 and second tape printing to perform printing on the second tape 500 in a state in which the ribbon cartridge 200 and the tape guide 400 are installed as shown in FIGS. 1 and 2.

The tape printing device P includes a device case 1, an installation-part cover 3, a first cartridge installation part 5, and a second cartridge installation part 7. The device case 1 is formed into a substantially rectangular shape. In the device case 1, a tape ejection port 9 is provided on a surface on its −X side, and the tape introduction port 11 is provided on a surface on its +X side. From the tape ejection port 9, the first tape 111 that has been printed or the second tape 500 that has been printed is ejected. The second tape 500 is introduced into the tape introduction port 11 from the outside of the tape printing device P.

The installation-part cover 3 is provided on the device case 1 so as to be rotatable about the end on its +Y side. The installation-part cover 3 opens and closes the first cartridge installation part 5 and the second cartridge installation part 7. The installation-part cover 3 is locked in a closed state by a cover lock mechanism (not shown). Then, when a cover open button (not shown) is pressed, the cover lock mechanism is brought into an unlocked state, whereby the installation-part cover 3 is opened.

On the inside surface of the installation-part cover 3, a first pressing protrusion 13, a second pressing protrusion 15, and a third pressing protrusion 17 are provided in a protruded state. When the installation-part cover 3 is closed in a state in which the ribbon cartridge 200 is installed in the second cartridge installation part 7, the first pressing protrusion 13, the second pressing protrusion 15, and the third pressing protrusion 17 are butted against the ribbon cartridge 200. For this reason, the ribbon cartridge 200 is installed in a state of being pressed by the first pressing protrusion 13, the second pressing protrusion 15, and the third pressing protrusion 17.

On the outside surface of the installation-part cover 3, a keyboard and a display are provided although not shown. The keyboard receives operations to input printing information such as character strings and issue various instructions such as performing printing. The display displays various information besides printing information input via the keyboard. When the keyboard receives an input operation to perform printing, the tape printing device P performs printing processing on the basis of printing information input via the keyboard. Note that the tape printing device P may be configured to include input display means such as a touch panel type display instead of the keyboard and the display. Further, the tape printing device P may be configured to perform printing processing on the basis of printing data and a command that are received from an external device such as a personal computer and a smart phone. When the tape printing device P is configured to be connectable to such an external device, the keyboard and the display may or may not be provided in the tape printing device P.

The first cartridge installation part 5 and the second cartridge installation part 7 are provided in the +Z side surface of the device case 1. In the first cartridge installation part 5, the tape cartridge 100 is detachably installed. In the second cartridge installation part 7, the ribbon cartridge 200 is detachably installed. The first cartridge installation part 5 and the second cartridge installation part 7 are formed into a recessed shape having an opening on their +Z side. For this reason, the tape cartridge 100 and the ribbon cartridge 200 are installed in the first cartridge installation part 5 and the second cartridge installation part 7, respectively, from the +Z side. Note that the installation direction of the tape cartridge 100 and the ribbon cartridge 200 will be simply called an "installation direction" below. Further, a front side in the installation direction represents the +Z side, and a back side in the installation direction represents a −Z side.

Figure 4:
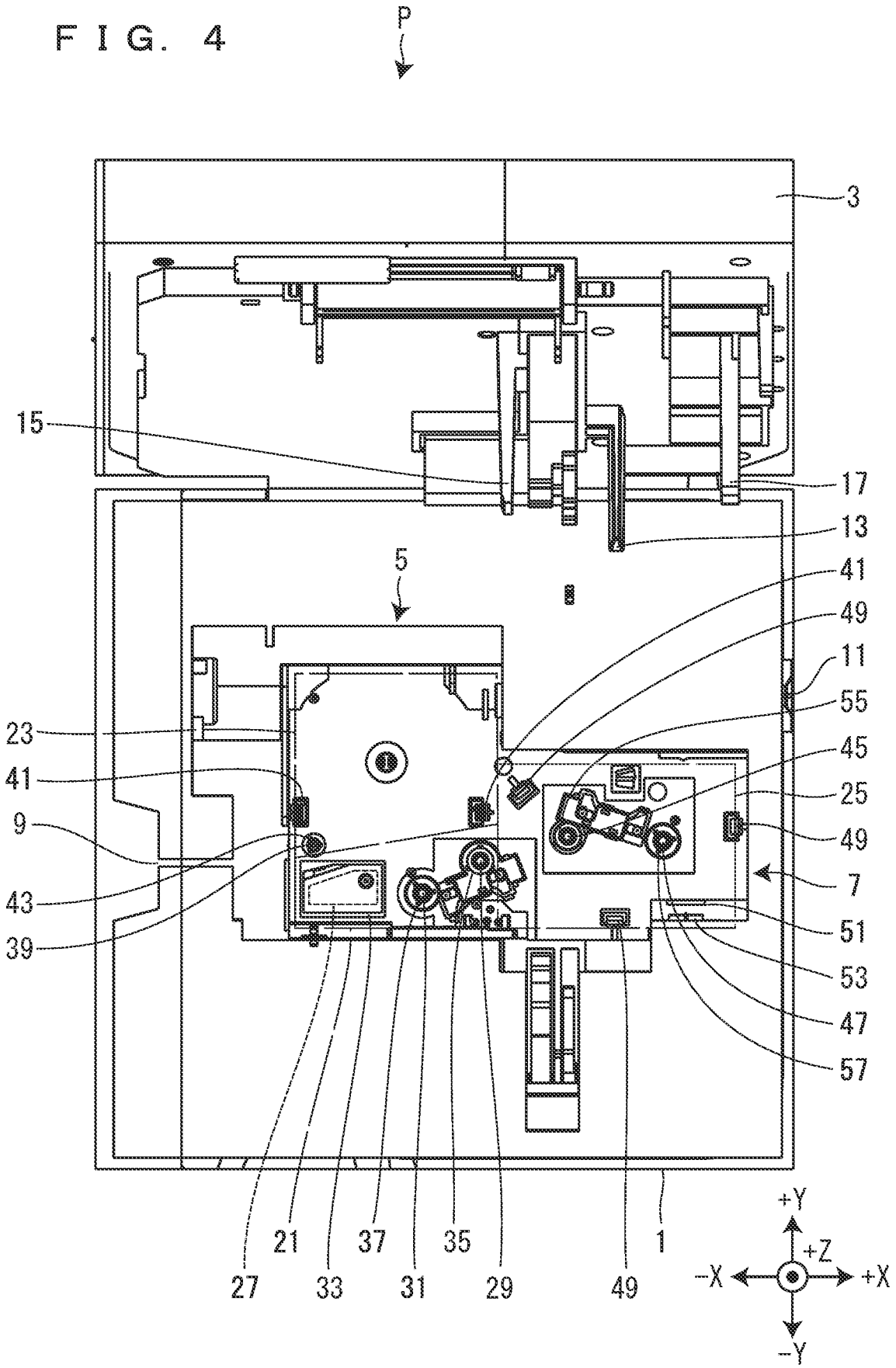
FIG. 4 is a view of the tape printing device when seen from the front side in the installation direction.

As shown in FIG. 4, the −Y side portion of the first cartridge installation part 5 and the −X side portion of the second cartridge installation part 7 are made common. Here, a portion at which the first cartridge installation part 5 and the second cartridge installation part 7 overlap each other is called an overlap region 21. Further, a portion outside the overlap region 21 in the first cartridge installation part 5 is called a first non-overlap region 23, and a portion outside the overlap region 21 in the second cartridge installation part 7 is called a second non-overlap region 25. The first non-overlap region 23 functions as a guide installation part in which the tape guide 400 is detachably installed. As described above, a part of the first cartridge installation part 5 and a part of the second cartridge installation part 7 are made common, whereby the tape printing device P can be further downsized in comparison with a configuration in which the first cartridge installation part 5 and the second cartridge installation part 7 are separately provided.

As shown in FIG. 3, the tape cartridge 100 is installed in the first cartridge installation part 5 when the first tape printing is performed. In this state, the tape printing device P performs printing on the first tape 111 while feeding the first tape 111 and the first ink ribbon 113 accommodated in the tape cartridge 100.

As shown in FIGS. 1 and 2, the tape guide 400 is installed in the first cartridge installation part 5 and the ribbon cartridge 200 is installed in the second cartridge installation part 7 when the second tape printing is performed. In this state, the tape printing device P performs printing on the second tape 500 while feeding the second tape 500 introduced from the tape introduction port 11 and the second ink ribbon 213 accommodated in the ribbon cartridge 200.

Note that the second tape 500 is provided as, for example, a tape roll wound in a roll shape. The length of the second tape 500 in a tape roll that is in an unused state and the length of the second ink ribbon 213 accommodated in the ribbon cartridge 200 are not particularly limited but are longer than the length of the first tape 111 and the length of the first ink ribbon 113 accommodated in the tape cartridge 100 that is in an unused state, respectively, in the present embodiment. For this reason, the second tape printing is performed, for example, when a large amount of labels are created at once.

[Tape Cartridge]

The tape cartridge 100 will be described on the basis of FIG. 3. The tape cartridge 100 includes a tape core 101, a first platen roller 103, a first paying-out core 105, a first winding core 107, and a first cartridge case 109 that rotatably accommodates the tape core 101, the first platen roller 103, the first paying-out core 105, and the first winding core 107. The first tape 111 is wound on the tape core 101. The first ink ribbon 113 is wound on the first paying-out core 105 with its ink-coated surface directed inward. Note that the first cartridge case 109 includes a plurality of types having different thicknesses, i.e., different sizes in the installation direction depending on the widths of the accommodated first tape 111 and the first ink ribbon 113.

The first cartridge case 109 is formed into a substantially "L-shape" when seen from the front side in the installation direction. In a substantially half part on the +Y side of the first cartridge case 109, a tape core accommodation part 115 is provided. In the tape core accommodation part 115, the tape core 101 is rotatably accommodated.

In a substantially half part on the −Y side of the first cartridge case 109, a first ribbon core accommodation part 117 and a first head insertion part (not shown) are provided on a +X side and a −X side, respectively. In the first ribbon core accommodation part 117, the first paying-out core 105 and the first winding core 107 are rotatably accommodated. The first head insertion part, the first paying-out core 105, and the first winding core 107 are provided at positions corresponding to a thermal head 27, a first paying-out shaft 29, and a first winding shaft 31 (see FIG. 4) provided in the overlap region 21, respectively. When the tape cartridge 100 is installed in the first cartridge installation part 5, the thermal head 27 is inserted into the first head insertion part. At the peripheral edge part of the first head insertion part, a first ribbon exposed part (not shown) at which the first ink ribbon 113 is exposed is provided. The first ink ribbon 113 fed from the first paying-out core 105 is wound by the first winding core 107 after passing through the first ribbon exposed part.

On a surface on the −X side of the first cartridge case 109, a tape delivery port 123 is provided. The first tape 111 that has been printed is fed to the outside of the first cartridge case 109 from the tape delivery port 123. Further, first hook engagement parts are provided on a surface on the +X side and the surface on the −X side of the first cartridge case 109 although not shown.

[Outline of Ribbon Cartridge]

The outline of the ribbon cartridge 200 will be described on the basis of FIG. 2. The ribbon cartridge 200 includes a second paying-out core 205, a second winding core 207, and a second cartridge case 209 that rotatably accommodates the second paying-out core 205 and the second winding core 207. The second ink ribbon 213 is wound on the second paying-out core 205 with its ink-coated surface directed inward. Hereinafter, the ink-coated surface of the second ink ribbon 213 will be called an ink surface 213*a*. Note that the second cartridge case 209 includes a plurality of types having different thicknesses depending on the width of the accommodated second ink ribbon 213.

The second cartridge case 209 is formed into a substantially rectangular shape long in its X direction when seen from the front side in the installation direction. A second ribbon core accommodation part 217 is provided on the +X side of the second cartridge case 209, and a second head insertion part 219 (see FIG. 5) is provided on the −X side thereof. In the second ribbon core accommodation part 217, the second paying-out core 205 and the second winding core 207 are rotatably accommodated. The second head insertion part 219, the second paying-out core 205, and the second winding core 207 are provided at positions corresponding to the thermal head 27, a second paying-out shaft 45 (see FIG. 4), and a second winding shaft 47, respectively, the thermal head 27 being provided in the overlap region 21, the second paying-out shaft 45 and the second winding shaft 47 being provided in the second non-overlap region 25. The second ink ribbon 213 is wound on the second paying-out core 205, and the second ink ribbon 213 is wound by the second winding core 207. For this reason, the center of gravity of the ribbon cartridge 200 is put at a position close to the side of the second ribbon core accommodation part 217 accommodating the second paying-out core 205 and the second winding core 207, that is, a position close to the +X side.

When the ribbon cartridge 200 is installed in the second cartridge installation part 7, the thermal head 27 is inserted into the second head insertion part 219. At the peripheral edge part of the second head insertion part 219, a second ribbon exposed part 221 (see FIG. 5) at which the second ink ribbon 213 is exposed is provided. The second ink ribbon 213 fed from the second paying-out core 205 is wound by the second winding core 207 after passing through the second ribbon exposed part 221. Further, the second hook engagement parts 225 are provided on a surface on the −Y side, a surface on the +X side, and a surface on +Y side of the second cartridge case 209 (see FIGS. 5, 7, and 9).

[Tape Guide]

The tape guide 400 will be described on the basis of FIG. 2. The tape guide 400 includes a roller support part 401 and a second platen roller 403. The roller support part 401 rotatably supports the second platen roller 403. Note that the tape guide 400 includes a plurality of types having different thicknesses depending on the width of the second tape 500 that is to be guided.

[Cartridge Installation Parts]

The first cartridge installation part 5 and the second cartridge installation part 7 will be described on the basis of FIG. 4. As described above, the first cartridge installation part 5 and the second cartridge installation part 7 can be classified into the overlap region 21, the first non-overlap region 23, and the second non-overlap region 25.

On a bottom surface in the overlap region 21, that is, on a back side surface in the installation direction in the overlap region 21, the thermal head 27, the first paying-out shaft 29, and the first winding shaft 31 are provided to protrude to the front side in the installation direction. The protrusion amount of the thermal head 27 to the front side in the installation direction is greater than those of the first paying-out shaft 29 and the first winding shaft 31. Note that a cutter is provided between the thermal head 27 and the tape ejection port 9 although not shown. The cutter cuts off the first tape 111 or the second tape 500 at the position between the thermal head 27 and the tape ejection port 9.

The thermal head 27 is covered with a head cover 33. When the tape cartridge 100 is installed in the first cartridge installation part 5, the head cover 33 is inserted into the first head insertion part. Further, when the ribbon cartridge 200 is installed in the second cartridge installation part 7, the head cover 33 is inserted into the second head insertion part 219.

A first paying-out rotation member 35 is rotatably provided on the first paying-out shaft 29. When the tape cartridge 100 is installed in the first cartridge installation part 5, the first paying-out shaft 29 is inserted into the first paying-out core 105 and the first paying-out rotation member 35 engages the first paying-out core 105. Further, when the ribbon cartridge 200 is installed in the second cartridge installation part 7, the first paying-out shaft 29 is inserted into a paying-out-side cylinder part 277 (see FIG. 9) provided in the ribbon cartridge 200.

A first winding rotation member 37 is rotatably provided on the first winding shaft 31. When the tape cartridge 100 is installed in the first cartridge installation part 5, the first winding shaft 31 is inserted into the first winding core 107 and the first winding rotation member 37 engages the first winding core 107. Further, when the ribbon cartridge 200 is installed in the second cartridge installation part 7, the first winding shaft 31 is inserted into a winding-side cylinder part 279 (see FIG. 9) provided in the ribbon cartridge 200.

On a bottom surface in the first non-overlap region 23, a platen shaft 39 and two first hooks 41 are provided to protrude to the front side in the installation direction.

A platen rotation member 43 is rotatably provided on the platen shaft 39. When the tape cartridge 100 is installed in the first cartridge installation part 5, the platen shaft 39 is inserted into the first platen roller 103 and the platen rotation member 43 engages the first platen roller 103. Further, when the tape guide 400 is installed in the first non-overlap region 23, the platen shaft 39 is inserted into the second platen roller 403 and the platen rotation member 43 engages the second platen roller 403.

The two first hooks 41 are provided at both ends in an X direction in the first non-overlap region 23 and engage the first hook engagement parts provided on the first cartridge case 109 when the tape cartridge 100 is installed in the first cartridge installation part 5. As a result, the tape cartridge 100 is prevented from being installed in a state of floating from the bottom surface of the first cartridge installation part 5.

On a bottom surface in the second non-overlap region 25, the second paying-out shaft 45, the second winding shaft 47, three second hooks 49, and a reception part 51 are provided to protrude to the front side in the installation direction. Further, a substrate connection part 53 is fixed to an inner peripheral surface on a −Y side in the second non-overlap region 25.

A second paying-out rotation member 55 is rotatably provided on the second paying-out shaft 45. When the ribbon cartridge 200 is installed in the second cartridge installation part 7, the second paying-out shaft 45 is inserted into the second paying-out core 205 and the second paying-out rotation member 55 engages the second paying-out core 205.

A second winding rotation member 57 is rotatably provided on the second winding shaft 47. When the ribbon cartridge 200 is installed in the second cartridge installation part 7, the second winding shaft 47 is inserted into the second winding core 207 and the second winding rotation member 57 engages the second winding core 207.

The three second hooks 49 are provided so as to surround the second paying-out shaft 45 and the second winding shaft 47. When the ribbon cartridge 200 is installed in the second cartridge installation part 7, the second hooks 49 engage the second hook engagement parts 225 provided on the second cartridge case 209.

The reception part 51 is provided at a position corresponding to a corner part on the +X side and the −Y side of the second cartridge installation part 7. When the ribbon cartridge 200 is installed in the second cartridge installation part 7, the reception part 51 is inserted into a reception insertion hole 297 (see FIG. 10) provided on the second cartridge case 209.

The substrate connection part 53 is provided at the end on a +X side on the inner peripheral surface on the −Y side of the second cartridge installation part 7. That is, the substrate connection part 53 is provided on the −Y side of the reception part 51. The substrate connection part 53 is connected to a control circuit (not shown) provided in the tape printing device P. When the ribbon cartridge 200 is installed in the second cartridge installation part 7, the substrate connection part 53 is connected to a circuit substrate 311 (see FIG. 5) provided in the ribbon cartridge 200. As a result, the control circuit can read various information stored in the circuit substrate 311 and also write various information in the circuit substrate 311.

When the tape cartridge 100 is installed in the first cartridge installation part 5 to perform the first tape printing in the tape printing device P configured as described above, the platen rotation member 43, the first paying-out rotation member 35, and the first winding rotation member 37 engage the first platen roller 103, the first paying-out core 105, and the first winding core 107, respectively. Then, when the installation-part cover 3 is closed, the thermal head 27 is moved toward the platen shaft 39 by a head movement mechanism (not shown). As a result, the first ink ribbon 113 exposed at the first ribbon exposed part is sandwiched between the thermal head 27 and the first platen roller 103 together with the first tape 111.

When a feeding motor (not shown) rotates in a forward direction in this state, the driving force of the feeding motor is transmitted to the platen rotation member 43, the first winding rotation member 37, and the second winding rotation member 57. Then, the first platen roller 103 having engaged the platen rotation member 43 rotates clockwise when seen from the front side in the installation direction, while the first winding core 107 having engaged the first winding rotation member 37 rotates counterclockwise when seen from the front side in the installation direction. As a result, the first tape 111 fed from the tape core 101 is fed toward the tape ejection port 9, while the first ink ribbon 113 fed from the first paying-out core 105 is wound by the first winding core 107. Note that the second winding rotation member 57 is brought into an idling state at this time.

When the feeding motor rotates in a reverse direction opposite to the forward direction, the driving force of the feeding motor is transmitted to the platen rotation member 43, the first paying-out rotation member 35, and the second paying-out rotation member 55. Then, the first platen roller 103 having engaged the platen rotation member 43 rotates counterclockwise when seen from the front side in the installation direction, while the first paying-out core 105 having engaged the first paying-out rotation member 35 rotates counterclockwise when seen from the front side in the installation direction. As a result, the first tape 111 fed from the tape core 101 is fed toward the tape core 101, while the first ink ribbon 113 fed from the first paying-out core 105 is rewound by the first paying-out core 105. Note that the second paying-out rotation member 55 is brought into an idling state at this time.

During the first tape printing, the tape printing device P causes the feeding motor to rotate in the forward direction to feed the first tape 111 toward the tape ejection port 9, and causes the thermal head 27 to generate heat while winding the first ink ribbon 113 on the first winding core 107 to perform printing on the first tape 111. After the end of the printing, the tape printing device P causes the cutter to perform a cutting operation to cut off a printed portion of the first tape 111. After that, the tape printing device P causes the feeding motor to rotate in the reverse direction to feed the first tape 111 toward the tape core 101 and rewind the first ink ribbon 113 on the first paying-out core 105. As a result, the first tape 111 is pulled back until the tip end of the first tape 111 comes close to the vicinity of the sandwiched position between the thermal head 27 and the first platen roller 103, that is, the vicinity of a printing position. For this reason, a margin caused at the front of the first tape 111 in the longitudinal direction due to the distance between the thermal head 27 and the cutter can be reduced in the first tape 111 that is to be next printed.

On the other hand, when the ribbon cartridge 200 is installed in the second cartridge installation part 7 to perform the second tape printing, the second paying-out rotation member 55 and the second winding rotation member 57 engage the second paying-out core 205 and the second winding core 207, respectively. In addition, when the tape guide 400 is installed in the first non-overlap region 23, the platen rotation member 43 engages the second platen roller 403. Further, the second tape 500 introduced from the tape introduction port 11 is set in the tape guide 400. Then, when the installation-part cover 3 is closed, the thermal head 27 moves toward the platen shaft 39. As a result, the second ink ribbon 213 exposed at the second ribbon exposed part 221 is sandwiched between the thermal head 27 and the second platen roller 403 together with the second tape 500.

When the feeding motor rotates in the forward direction in this state, the driving force of the feeding motor is transmitted to the platen rotation member 43, the first winding rotation member 37, and the second winding rotation member 57. Then, the second platen roller 403 having engaged the platen rotation member 43 rotates clockwise when seen from the front side in the installation direction, while the second winding core 207 having engaged the second winding rotation member 57 rotates counterclockwise when seen from the front side in the installation direction. As a result, the second tape 500 introduced from the tape introduction port 11 is fed toward the tape ejection port 9, while the second ink ribbon 213 fed from the second paying-out core 205 is wound by the second winding core 207. Note that the first winding rotation member 37 is brought into an idling state at this time.

When the feeding motor rotates in the reverse direction, the driving force of the feeding motor is transmitted to the platen rotation member 43, the first paying-out rotation member 35, and the second feeding rotation member 55. Then, the second platen roller 403 having engaged the platen rotation member 43 rotates counterclockwise when seen from the front side in the installation direction, while the second paying-out core 205 having engaged the second paying-out rotation member 55 rotates counterclockwise when seen from the front side in the installation direction. As a result, the second tape 500 introduced from the tape introduction port 11 is fed toward the tape introduction port 11, while the second ink ribbon 213 fed from the second paying-out core 205 is rewound by the second paying-out core 205. Note that the first paying-out rotation member 35 is brought into an idling state at this time.

During the second tape printing, the tape printing device P causes the feeding motor to rotate in the forward direction like the case of the first tape printing to feed the second tape 500 toward the tape ejection port 9, and causes the thermal head 27 to generate heat while winding the second ink ribbon 213 on the second winding core 207 to perform printing on the second tape 500. After the end of the printing, the tape printing device P causes the cutter to perform a cutting operation to cut off a printed portion of the second tape 500. After that, the tape printing device P causes the feeding motor to rotate in the reverse direction to rewind the second ink ribbon 213 on the second paying-out core 205 while feeding the second tape 500 toward the tape introduction port 11. As a result, the second tape 500 is pulled back until the tip end of the second tape 500 comes close to the vicinity of the sandwiched position between the thermal head 27 and the second platen roller 403, that is, the vicinity of a printing position. For this reason, a margin caused at the front of the second tape 500 in the longitudinal direction due to the distance between the thermal head 27 and the cutter can be reduced in the second tape 500 that is to be next printed.

[Details of Ribbon Cartridge]

Figure 5:
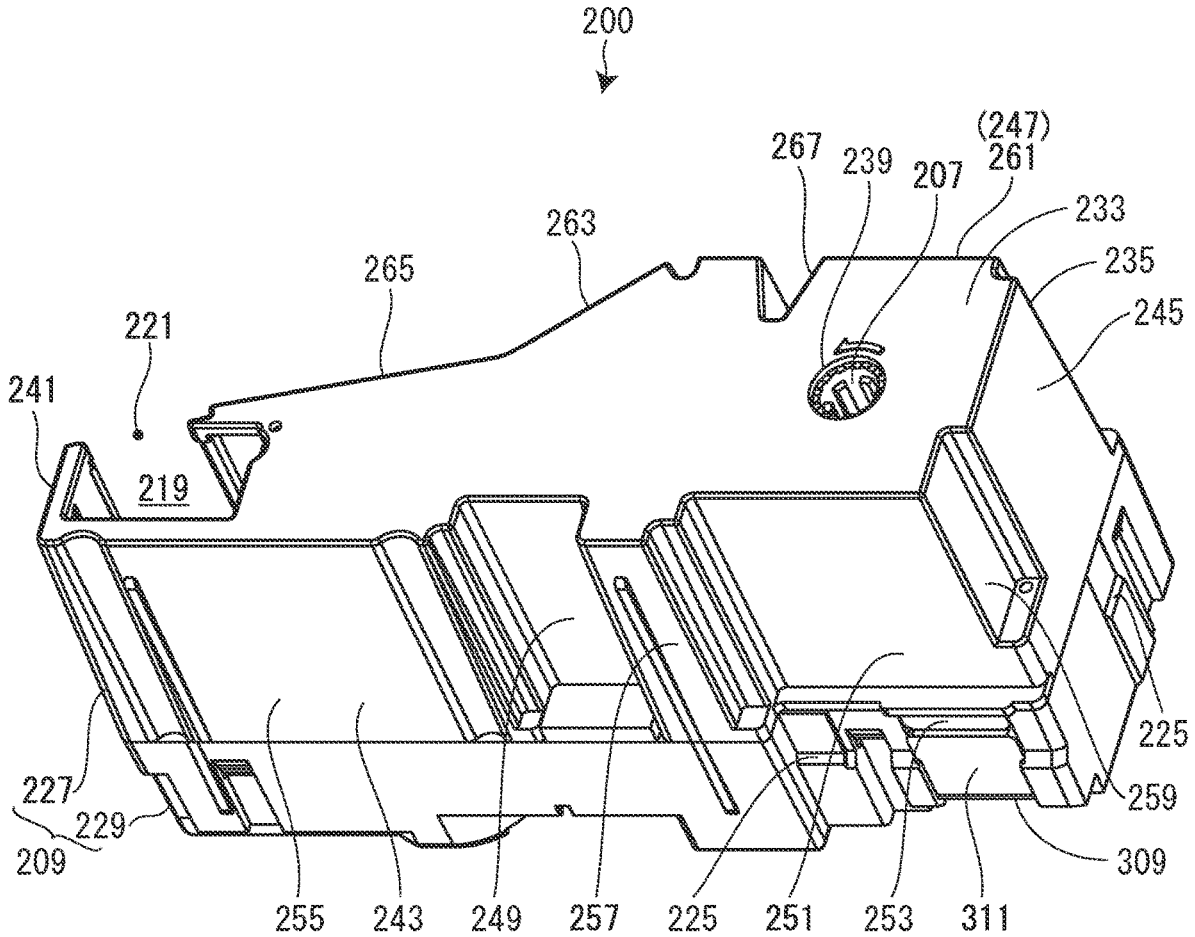
FIG. 5 is a perspective view of the ribbon cartridge.
Figure 5:
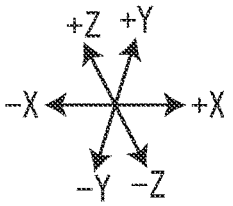

The ribbon cartridge 200 will be further described on the basis of FIGS. 5 to 11. As shown in FIG. 5, the second cartridge case 209 includes a front-side case 227 and a back-side case 229. The front-side case 227 and the back-side case 229 are an example of the "first case" and an example of the "second case" of the present invention, respectively. When the ribbon cartridge 200 is installed in the second cartridge installation part 7, the front-side case 227 is arranged on the front side in the installation direction. When the ribbon cartridge 200 is installed in the second cartridge installation part 7, the back-side case 229 is arranged on the back side in the installation direction. The front-side case 227 is a resin molded article having translucency, and the back-side case 229 is a resin molded article having no translucency. However, the materials or manufacturing methods of the front-side case 227 and the back-side case 229 are not limited to this.

Figure 6:
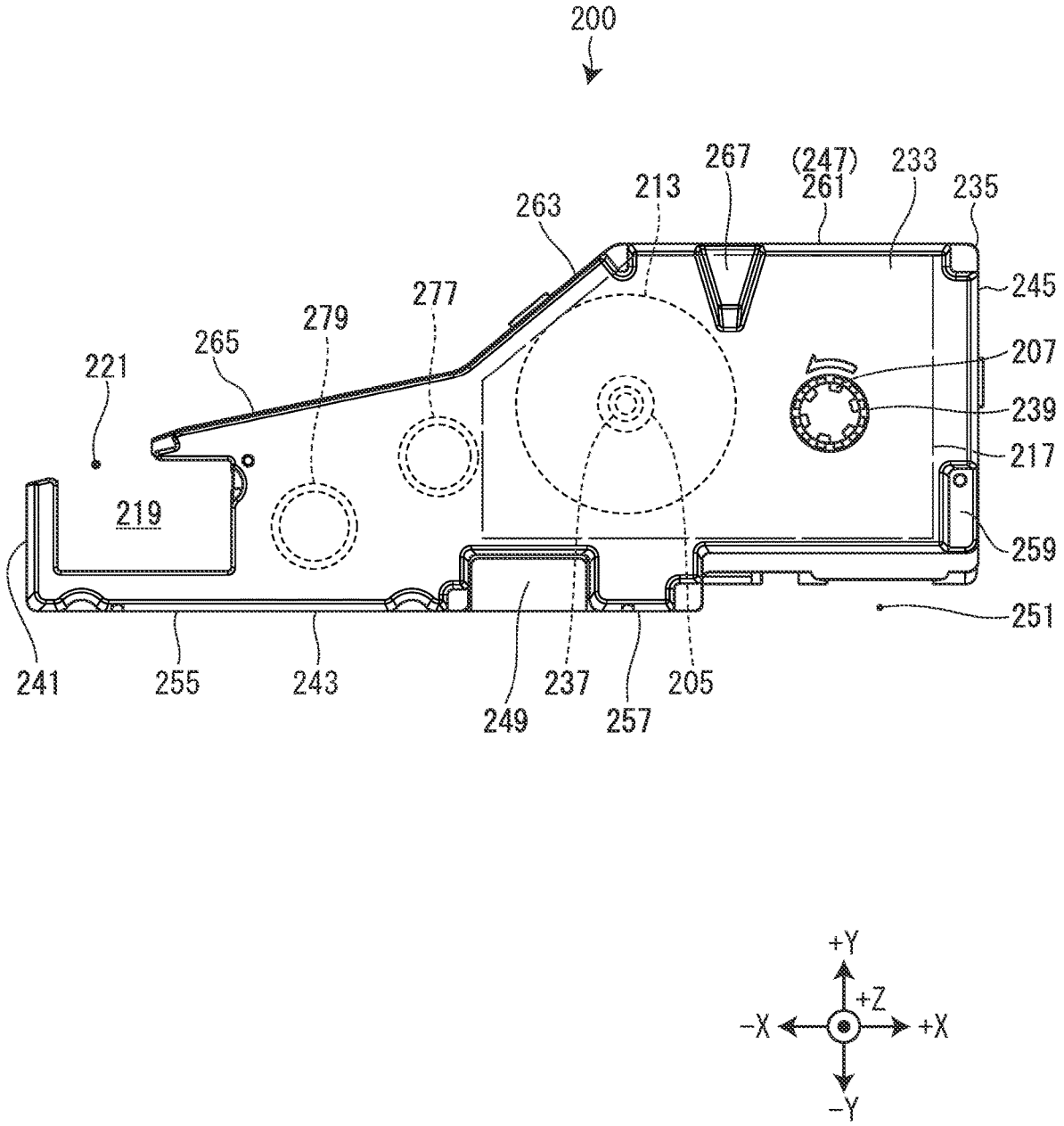
FIG. 6 is a view of the ribbon cartridge when seen from the front side in the installation direction.

As shown in FIGS. 5 and 6, a grabbing part 231 for grabbing the second cartridge case 209 is provided at a position close to the +X side of the second cartridge case 209 on the front-side case 227. As described above, the center of gravity of the ribbon cartridge 200 is put at a position close to the +X side since the second ribbon core accommodation part 217 in which the second paying-out core 205 and the second winding core 207 are accommodated is provided at a position close to the +X side of the second cartridge case. For this reason, a user can grab a portion close to the +X side at which the center of gravity of the ribbon cartridge 200 is put by using the grabbing part 231 provided at the position close to the +X side of the front-side case 227. Accordingly, the user can stably grab the ribbon cartridge 200.

The front-side case 227 includes a front-side wall part 233 and a first peripheral wall part 235. When the ribbon cartridge 200 is installed in the second cartridge installation part 7, the front-side wall part 233 is arranged on the front side in the installation direction. On the front-side wall part 233, a front-side paying-out boss 237 and a front-side winding opening 239 are provided. The front-side paying-out boss 237 and the front-side winding opening 239 are provided in a second ribbon core accommodation part 217. The front-side paying-out boss 237 and the front-side winding opening 239 are provided at positions corresponding to the second paying-out shaft 45 and the second winding shaft 47 provided in the second cartridge installation part 7, respectively. The front-side paying-out boss 237 protrudes to the back side in the installation direction from the inner surface of the front-side wall part 233 and engages the end on the front side of the second paying-out core 205 in the installation direction. The front-side winding opening 239 engages the end on the front side of the second winding core 207 in the installation direction.

The first peripheral wall part 235 extends to the back side in the installation direction from the peripheral edge part of the front-side wall part 233. The first peripheral wall part 235 includes a front-side first wall part 241 positioned on its −X side, a front-side second wall part 243 positioned on its −Y side, a front-side third wall part 245 positioned on its +X side, and a front-side fourth wall part 247 positioned on its +Y side. At a position at which the front-side first wall part 241 and the front-side fourth wall part 247 cross each other, the second ribbon exposed part 221 at which the second ink ribbon 213 is exposed is provided.

Figure 7:
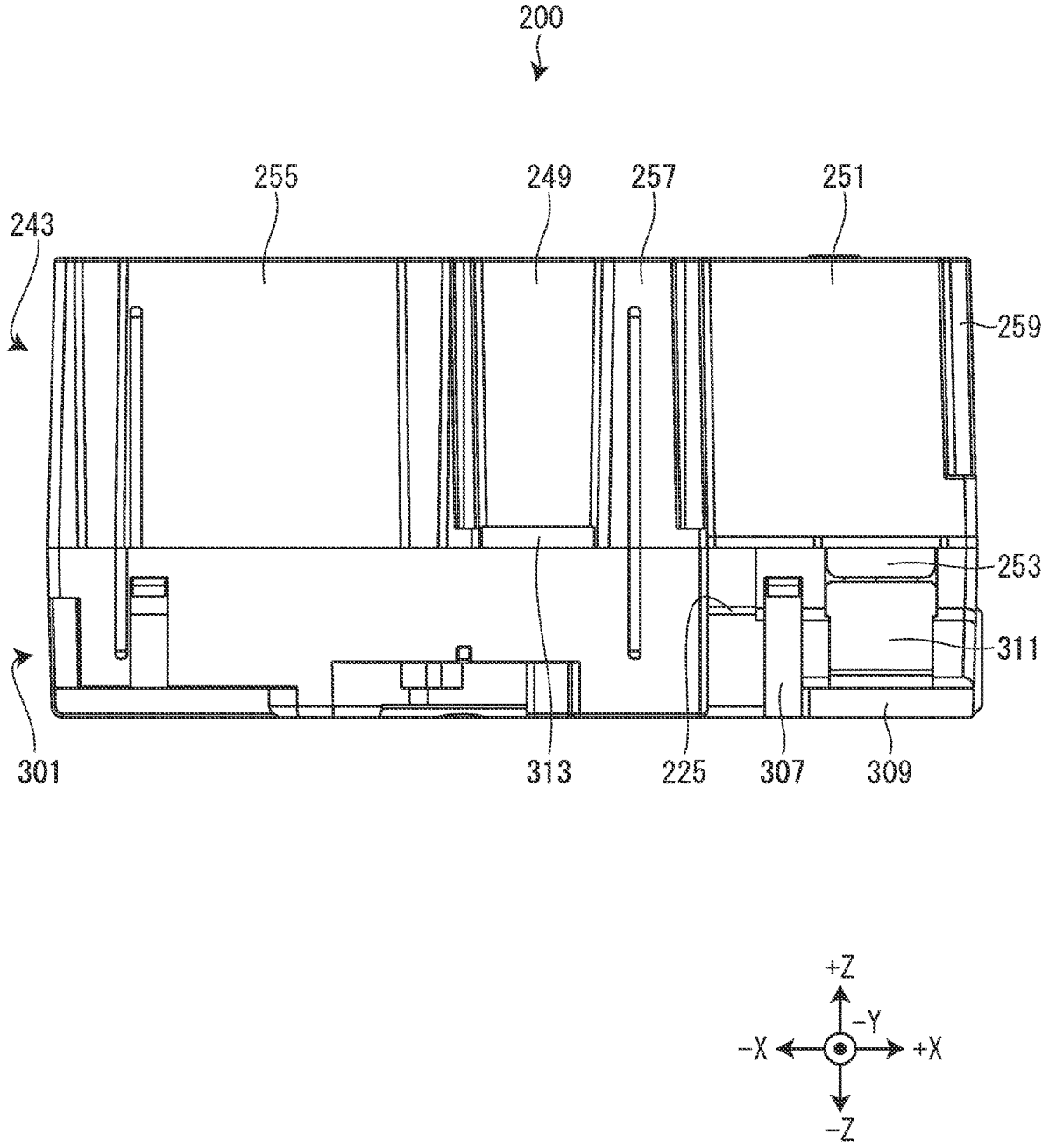
FIG. 7 is a view of the ribbon cartridge when seen from its −Y side.

As shown in FIGS. 5 to 7, a second peripheral wall recessed part 249 is provided at the substantially middle part of the front-side second wall part 243 in the X direction. The second peripheral wall recessed part 249 is formed into a shape recessed in a substantially rectangular shape slightly long in the X direction when seen from the front side in the installation direction. In the second peripheral wall recessed part 249, the front-side second wall part 243 is entirely recessed in the installation direction.

At the end on the +X side of the front-side second wall part 243, a fourth peripheral wall recessed part 251 is provided. The fourth peripheral wall recessed part 251 is formed into a shape recessed in a substantially rectangular shape long in the X direction when seen from the front side in the installation direction. In the fourth peripheral wall recessed part 251, the front-side second wall part 243 is substantially entirely recessed in the installation direction like the second peripheral wall recessed part 249. In a region on the +X side of the front-side second wall part 243, a substrate coming-off prevention part 253 is provided to protrude on an end surface on the back side in the installation direction. The substrate coming-off prevention part 253 prevents the circuit substrate 311 attached to a substrate attachment part 309 provided in the back-side case 229 from coming off the substrate attachment part 309.

Note that a first flat part 255 positioned on a side closer to the −X side than the second peripheral wall recessed part 249 and a second flat part 257 positioned between the second peripheral wall recessed part 249 and the fourth peripheral wall recessed part 251 are substantially flush with each other in the front-side second wall part 243. In the case of a configuration in which the second flat part 257 is not provided and the second peripheral wall recessed part 249 and the fourth peripheral wall recessed part 251 are connected to each other, there is a likelihood that, when the ribbon cartridge 200 is placed on a placement surface such as a desk with the front-side second wall part 243 directed downward, the fourth peripheral wall recessed part 251 positioned on the side of the center of gravity of the ribbon cartridge 200 is butted against the placement surface and the first flat part 255 obliquely floats with respect to the placement surface. In this case, the ribbon cartridge 200 is placed in a state of easily rattling with respect to the placement surface. On the other hand, the second flat part 257 is provided in the present embodiment, and thus the second flat part 257 is butted against the placement surface when the ribbon cartridge 200 is placed on the placement surface with the front-side second wall part 243 directed downward. Therefore, the fourth peripheral wall recessed part 251 is prevented from being butted against the placement surface, and the first flat part 255 is prevented from obliquely floating with respect to the placement surface. For this reason, the ribbon cartridge 200 can be placed on the placement surface in a secured state.

As shown in FIGS. 5 and 6, a third peripheral wall recessed part 259 is provided at the end on the −Y side of the front-side third wall part 245. The third peripheral wall recessed part 259 is formed into a shape recessed in a substantially rectangular shape long in a Y direction when seen from the front side in the installation direction. The end on the −Y side of the third peripheral wall recessed part 259 is connected to the end on the +X side of the fourth peripheral wall recessed part 251. In the third peripheral wall recessed part 259, the front-side third wall part 245 is recessed with its end on the back side in the installation direction left.

Figure 8:
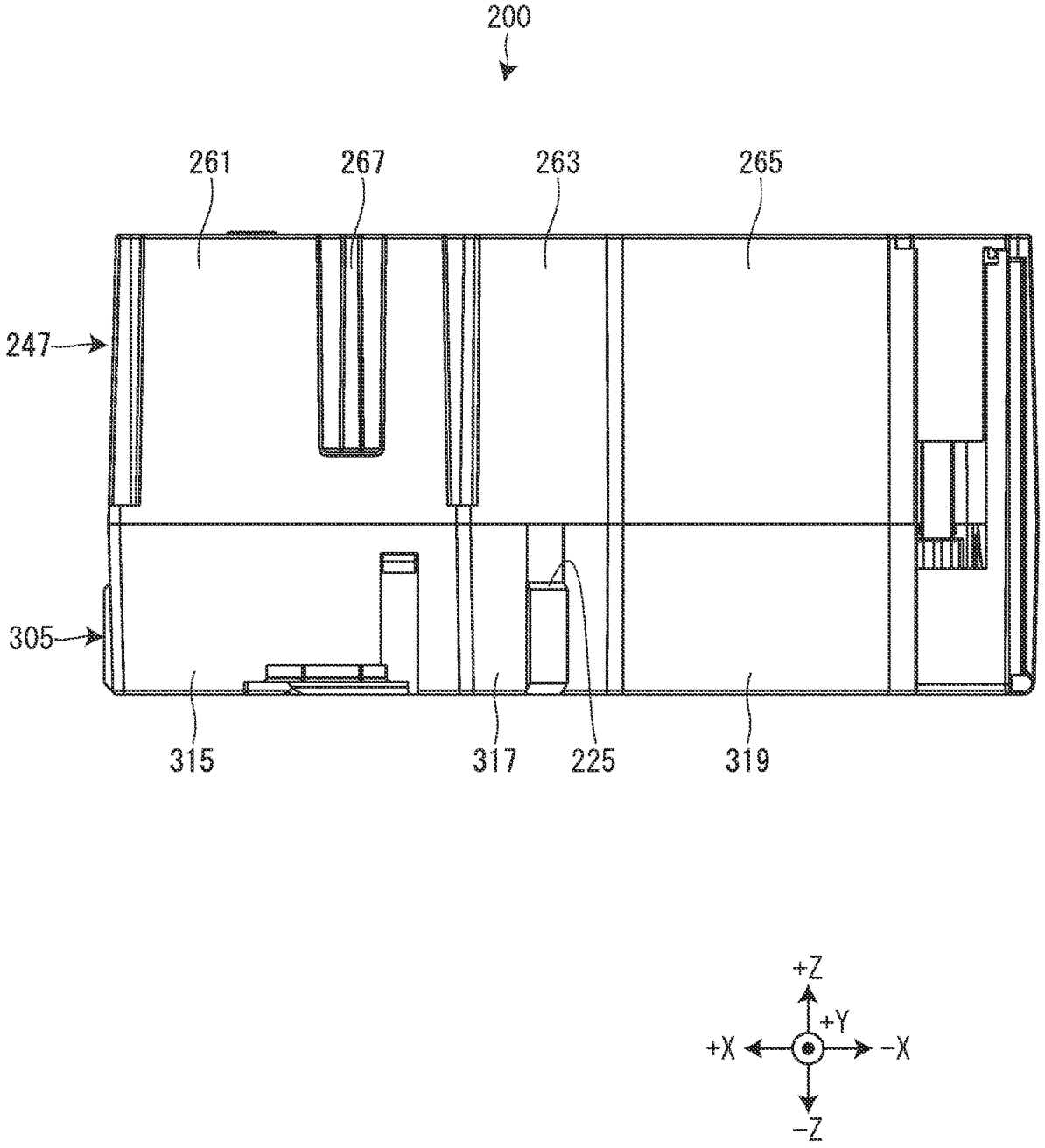
FIG. 8 is a view of the ribbon cartridge when seen from its +Y side.

As shown in FIGS. 5, 6, and 8, the front-side fourth wall part 247 includes a front-side first portion wall part 261, a front-side second portion wall part 263, and a front-side third portion wall part 265. The front-side first portion wall part 261 extends to the −X side from the end of the front-side third wall part 245 on the +Y side. The front-side second portion wall part 263 extends from the end of the front-side first portion wall part 261 on the −X side, bending in an oblique direction between the −X side and the −Y side. The front-side third portion wall part 265 extends from the end of the front-side second portion wall part 263 on the −X side, bending at an angle nearly parallel to the X direction than the front-side second portion wall part 263.

On the front-side first portion wall part 261, a first peripheral wall recessed part 267 is provided. The first peripheral wall recessed part 267 is formed into a shape recessed in a substantially trapezoidal shape which is long in the Y direction when seen from the front side in the installation direction. In the first peripheral wall recessed part 267, the front-side fourth wall part 247 is recessed with its end on the back side in the installation direction left like the third peripheral wall recessed part 259.

Figure 9:
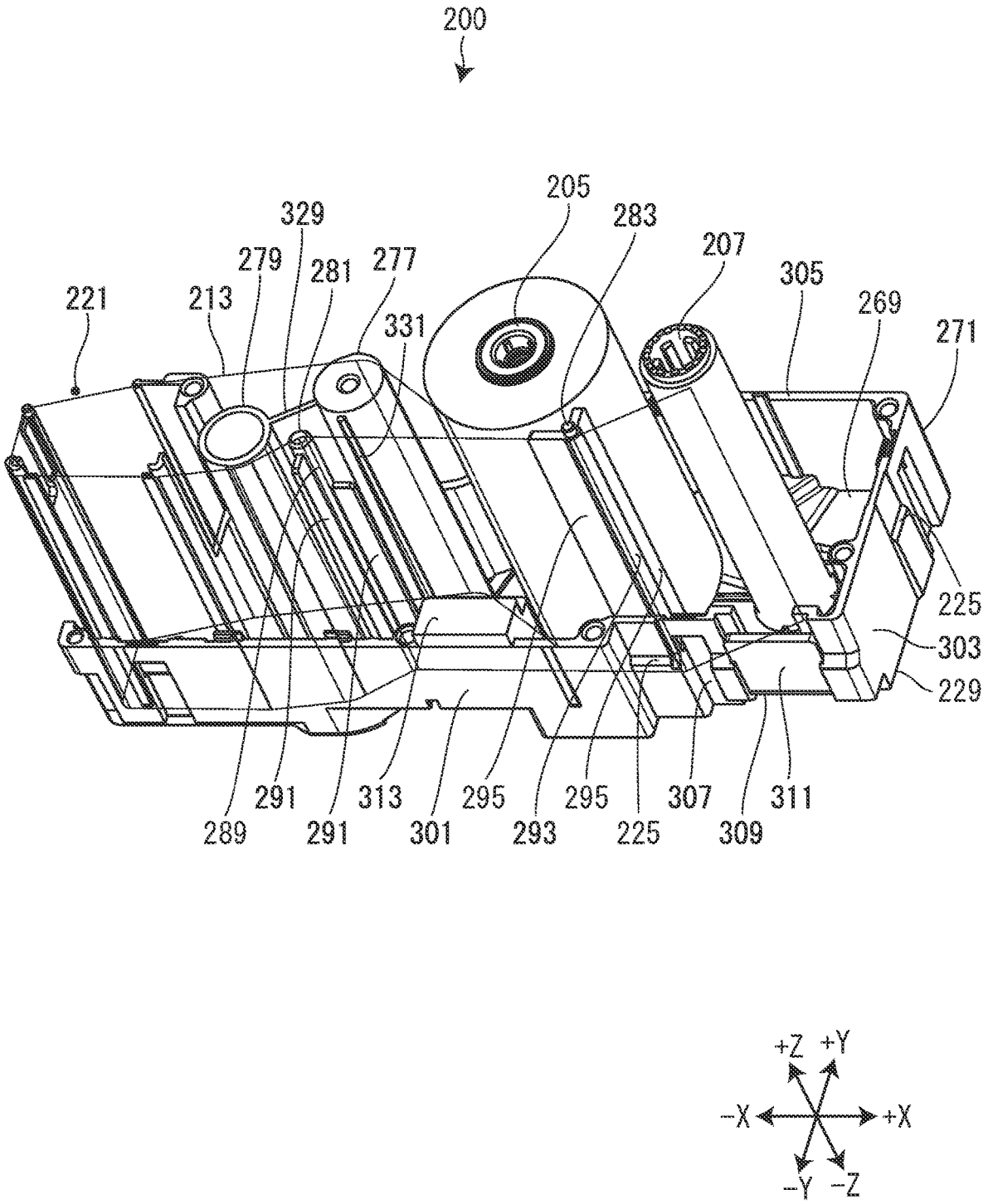
FIG. 9 is a perspective view of the ribbon cartridge in a state in which a front-side case is removed.

As shown in FIG. 9, the back-side case 229 includes a back-side wall part 269 and a second peripheral wall part 271. When the ribbon cartridge 200 is installed in the second cartridge installation part 7, the back-side wall part 269 is arranged on the back side in the installation direction. The back-side wall part 269 faces the front-side wall part 233 of the front-side case 227.

Figure 10:
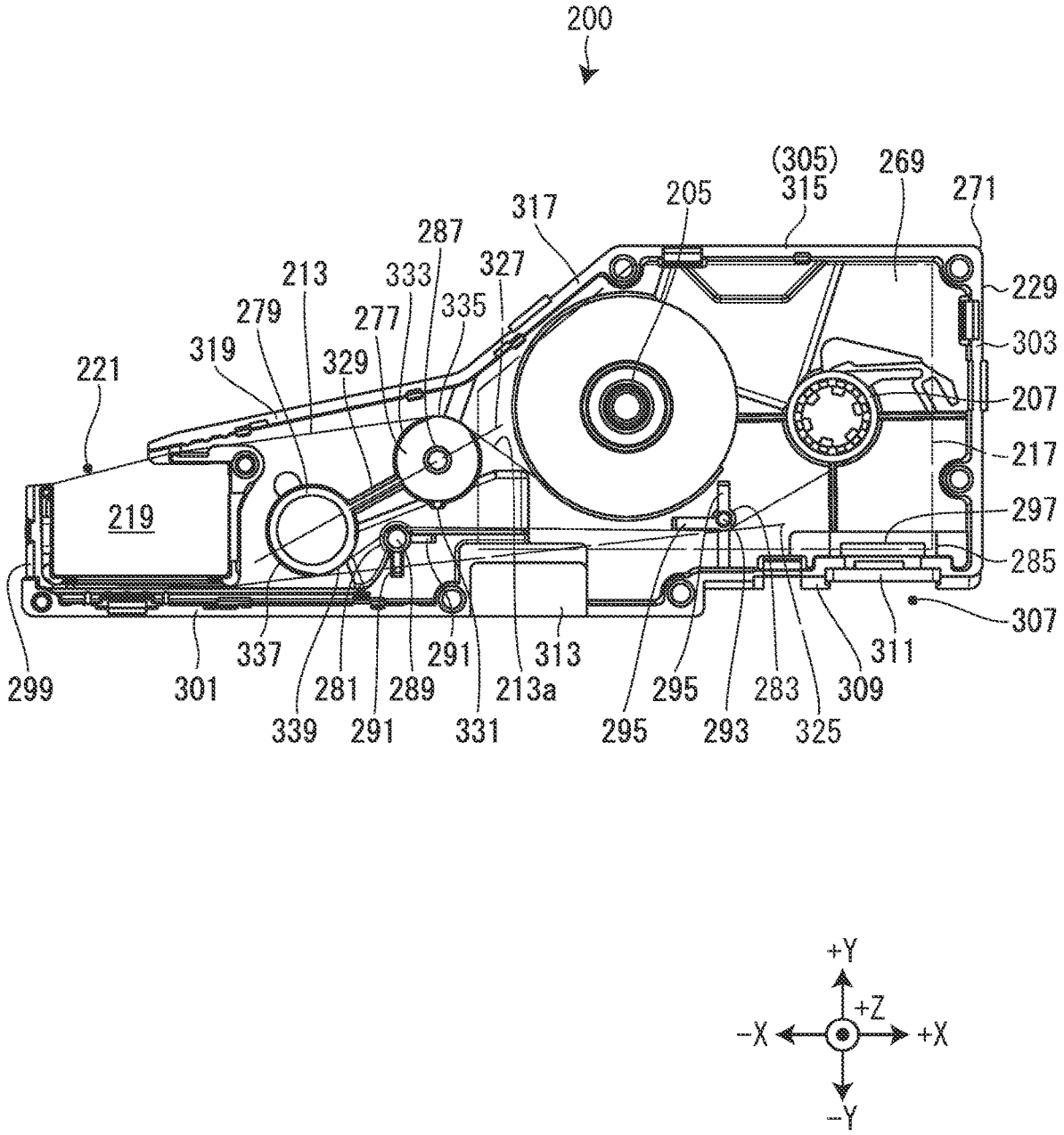
FIG. 10 is a view of the ribbon cartridge when seen from the front side in the installation direction in a state in which the front-side case is removed.
Figure 11:
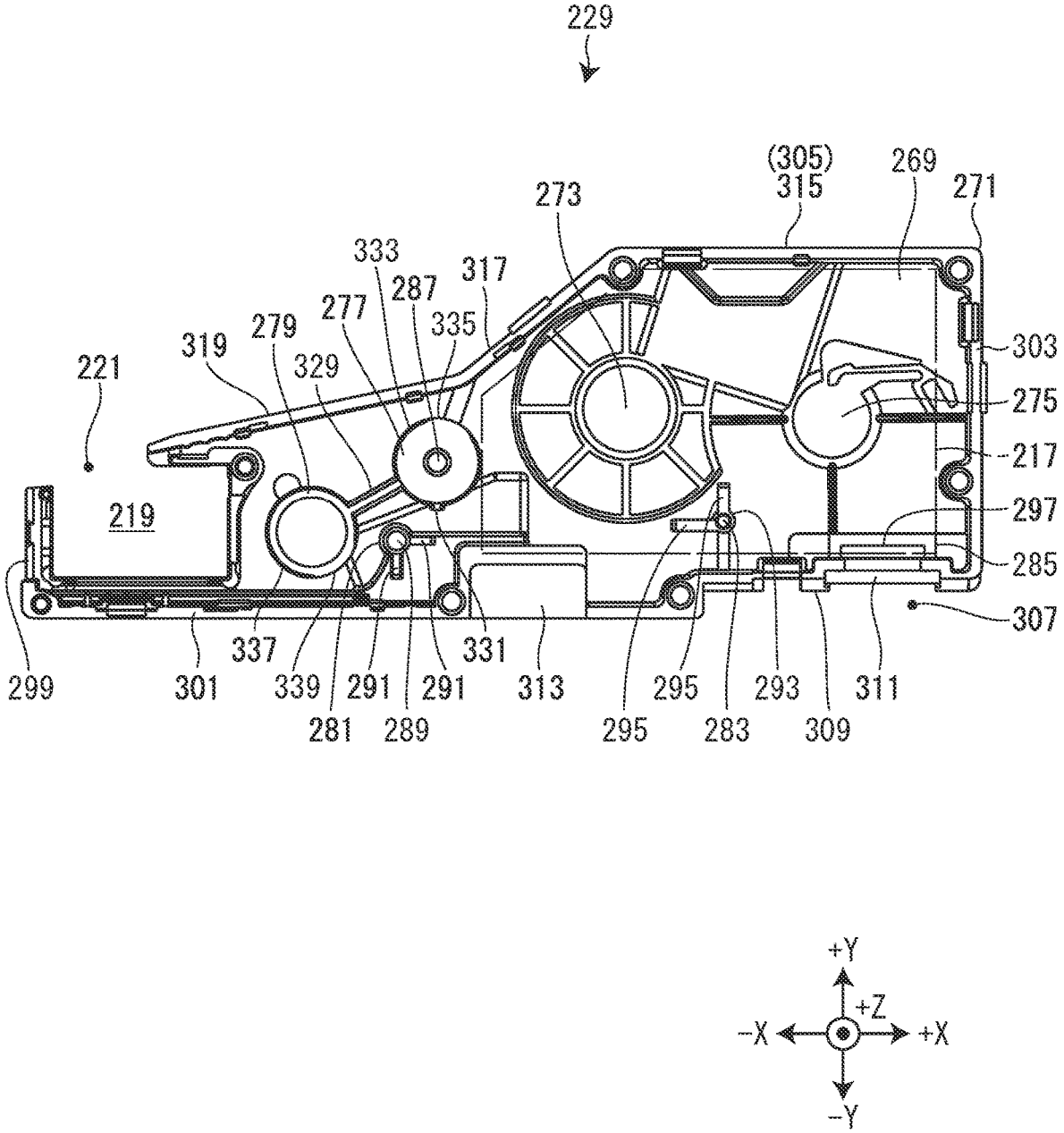
FIG. 11 is a view of a back-side case when seen from the front side in the installation direction.

As shown in FIGS. 9 to 11, a back-side paying-out opening 273, a back-side winding opening 275, a paying-out-side cylinder part 277, a winding-side cylinder part 279, a first ribbon guide 281, a second ribbon guide 283, and a reception insertion part 285 are provided on the back-side wall part 269.

The back-side paying-out opening 273 and the back-side winding opening 275 are provided in the second ribbon core accommodation part 217. The back-side paying-out opening 273 and the back-side winding opening 275 are provided at positions corresponding to the second paying-out shaft 45 and the second winding shaft 47 provided in the second cartridge installation part 7, respectively. The back-side paying-out opening 273 engages the end of the second paying-out core 205 on the back side in the installation direction. The back-side winding opening 275 engages the end of the second winding core 207 on the back side in the installation direction. Hereinafter, the feeding direction of the second ink ribbon 213 will be simply called a "feeding direction." Further, in the feeding direction, an upstream side represents the side of the second paying-out core 205, and a downstream side represents the side of the second winding core 207.

The paying-out-side cylinder part 277 and the winding-side cylinder part 279 are positioned between the second ribbon core accommodation part 217 and the second head insertion part 219 and provided to protrude to the front side in the installation direction from the back-side wall part 269. The paying-out-side cylinder part 277 and the winding-side cylinder part 279 are provided at positions corresponding to the first paying-out shaft 29 and the first winding shaft 31 provided in the overlap region 21, respectively.

The paying-out-side cylinder part 277 is formed into a substantially cylindrical shape with a lid. When the ribbon cartridge 200 is installed in the second cartridge installation part 7, the first paying-out shaft 29 provided in the overlap region 21 is inserted into the paying-out-side cylinder part 277. As a result, when the ribbon cartridge 200 is installed in the second cartridge installation part 7, the first paying-out shaft 29 is prevented from interfering with the ribbon cartridge 200. The paying-out-side cylinder part 277 has an inner diameter to such an extent that a gap is generated between the paying-out-side cylinder part 277 and the first paying-out rotation member 35 provided on the first paying-out shaft 29. For this reason, even when the first paying-out rotation member 35 rotates, the first paying-out rotation member 35 does not slide against the inner peripheral surface of the paying-out-side cylinder part 277. Note that a press-fitting hole 287 into which a press-fitting pin (not shown) provided on the front-side case 227 is press-fitted is provided on the front side of the paying-out-side cylinder part 277 in the installation direction.

Further, the paying-out-side cylinder part 277 is positioned on the downstream side of the second paying-out core 205 in the feeding direction and guides the second ink ribbon 213 fed from the second paying-out core 205 to the second ribbon exposed part 221 by causing the same to contact a part on the +Y side of its peripheral surface. That is, the paying-out-side cylinder part 277 into which the first paying-out shaft 29 is inserted can also function as a guide member that guides the second ink ribbon 213. Note that the paying-out-side cylinder part 277 may be constituted by a cylinder part provided on the front-side case 227 and a cylinder part provided on the back-side case 229. However, in the present embodiment, the paying-out-side cylinder part 277 is provided on one of the front-side case 227 and the back-side case 229, that is, only on the back-side case 229. For this reason, the second ink ribbon 213 can be properly guided without causing a stepped part on the peripheral surface of the paying-out-side cylinder part 277. Further, the shape of the paying-out-side cylinder part 277 is not limited to a cylindrical shape but may be, for example, an elliptic cylindrical shape, a semi-cylindrical shape, or a square tube shape.

The winding-side cylinder part 279 is formed into a substantially cylindrical shape. When the ribbon cartridge 200 is installed in the second cartridge installation part 7, the first winding shaft 31 provided in the overlap region 21 is inserted into the winding-side cylinder part 279. As a result, when the ribbon cartridge 200 is installed in the second cartridge installation part 7, the first winding shaft 31 is prevented from interfering with the ribbon cartridge 200. The winding-side cylinder part 279 has an inner diameter to such an extent that a gap is generated between the winding-side cylinder part 279 and the first winding rotation member 37 provided at the first winding shaft 31. For this reason, even when the first winding rotation member 37 rotates, the first winding rotation member 37 does not slide against the inner peripheral surface of the winding-side cylinder part 279.

Further, the winding-side cylinder part 279 is positioned on the downstream side of the second ribbon exposed part 221 in the feeding direction and guides the second ink ribbon 213 fed from the second ribbon exposed part 221 to the second winding core 207 by causing the same to contact a part on the −Y side of its peripheral surface. That is, the winding-side cylinder part 279 into which the first winding shaft 31 is inserted can also function as a guide member that guides the second ink ribbon 213. Note that the winding-side cylinder part 279 may be constituted by a cylinder part provided on the front-side case 227 and a cylinder part provided on the back-side case 229. However, in the present embodiment, the winding-side cylinder part 279 is provided on one of the front-side case 227 and the back-side case 229, that is, only on the back-side case 229. For this reason, the second ink ribbon 213 can be properly guided without causing a stepped part on the peripheral surface of the winding-side cylinder part 279. Further, like the shape of the paying-out-side cylinder part 277, the shape of the winding-side cylinder part 279 is not limited to a cylindrical shape but may be, for example, an elliptic cylindrical shape, a semi-cylindrical shape, or a square tube shape.

The first ribbon guide 281 guides the second ink ribbon 213 at a position closer to the downstream side of the second ink ribbon 213 in the feeding direction than the winding-side cylinder part 279. The first ribbon guide 281 is formed to be integrated with the back-side wall part 269. The first ribbon guide 281 includes a first guide body 289 and two first guide ribs 291. The first guide body 289 is formed into a substantially columnar shape, contacts the ink surface 213*a* of the second ink ribbon 213, and guides the second ink ribbon 213. The two first guide ribs 291 protrude to the +X side and the −Y side from the peripheral surface of the first guide body 289. The first guide ribs 291 prevent the first guide body 289 from being inclined due to a pressure received from the second ink ribbon 213 fed in an appropriately tensed state.

The second ribbon guide 283 guides the second ink ribbon 213 at a position closer to the downstream side in the feeding direction than the first ribbon guide 281. The second ribbon guide 283 is formed to be integrated with the back-side wall part 269. Like the first ribbon guide 281, the second ribbon guide 283 includes a second guide body 293 and two second guide ribs 295. The second guide body 293 is formed into a substantially columnar shape, contacts a surface on a side opposite to the ink surface 213*a* of the second ink ribbon 213, and guides the second ink ribbon 213. The two second guide ribs 295 protrude to the −X side and the +Y side from the peripheral surface of the second guide body 293. The second guide ribs 295 prevent the second guide body 293 from being inclined due to a pressure received from the second ink ribbon 213.

The reception insertion part 285 is positioned at a corner on the +X side and the −Y side of the back-side wall part 269 and provided to protrude to the front side in the installation direction. In the reception insertion part 285, the reception insertion hole 297 is provided to penetrate in the installation direction. When the ribbon cartridge 200 is installed in the second cartridge installation part 7, the reception part 51 is inserted into the reception insertion hole 297.

The second peripheral wall part 271 extends to the front side in the installation direction from the peripheral edge part of the back-side wall part 269. The end surface on the front side of the second peripheral wall part 271 in the installation direction is in contact with the end surface on the back side of the first peripheral wall part 235 of the front-side case 227 in the installation direction. The second peripheral wall part 271 includes a back-side first wall part 299 positioned on the −X side, a back-side second wall part 301 positioned on the −Y side, a back-side third wall part 303 positioned on the +X side, and a back-side fourth wall part 305 positioned on the +Y side. At a position at which the back-side first wall part 299 and the back-side fourth wall part 305 cross each other, the second ribbon exposed part 221 is provided.

As shown in FIG. 7 and FIGS. 9 to 11, a back-side peripheral wall recessed part 307 is provided at the end of the back-side second wall part 301 on the +X side so as to correspond to the above fourth peripheral wall recessed part 251. Like the fourth peripheral wall recessed part 251, the back-side peripheral wall recessed part 307 is formed into a shape recessed in a substantially rectangular shape long in the X direction when seen from the front side in the installation direction. In the region of the back-side peripheral wall recessed part 307 on the +X side and the +Y side, the substrate attachment part 309 is provided. The circuit substrate 311 is attached to the substrate attachment part 309. The circuit substrate 311 includes a storage element. In the storage element, information such as the width of the second ink ribbon 213 and the remaining amount of the second ink ribbon 213 wound on the second paying-out core 205 is stored. Further, since the substrate attachment part 309 is provided in the region of the back-side peripheral wall recessed part 307 on the +X side and the +Y side, the circuit substrate 311 attached to the substrate attachment part 309 is prevented from being butted against a floor surface or the like even in, for example, a case in which the ribbon cartridge 200 is dropped by mistake. As a result, the circuit substrate 311 can be prevented from being scratched or stained.

At the substantially middle part of the back-side second wall part 301 in the X direction, that is, a position corresponding to the second peripheral wall recessed part 249, a peripheral wall protrusion part 313 protruding to the front side in the installation direction from the end surface on the front side in the installation direction is provided. The peripheral wall protrusion part 313 is inserted into the second peripheral wall recessed part 249 from the back side in the installation direction.

As shown in FIGS. 8, 10, and 11, the back-side fourth wall part 305 includes a back-side first portion wall part 315, a back-side second portion wall part 317, and a back-side third portion wall part 319. The back-side first portion wall part 315 extends to the −X side from the end of the back-side third wall part 303 on the +Y side. The back-side second portion wall part 317 extends from the end of the back-side first portion wall part 315 on the −X side, bending in an oblique direction between the −X side and the −Y side. The back-side third portion wall part 319 extends from the end of the back-side second portion wall part 317 on the −X side, bending at an angle nearly parallel to the X direction than the back-side second portion wall part 317.

As shown in FIG. 5 and FIGS. 7 to 9, the second hook engagement parts 225 are provided on the back-side second wall part 301, the back-side third wall part 303, and the back-side second portion wall part 317. That is, the three second hook engagement parts 225 are provided at the peripheral edge part of the second ribbon core accommodation part 217 when seen from the front side in the installation direction. When the ribbon cartridge 200 is installed in the second cartridge installation part 7, the second hooks 49 engage the second hook engagement parts 225. As a result, the ribbon cartridge 200 is prevented from being installed in a state of floating from the bottom surface of the second cartridge installation part 7.

[Feeding-Side Cylinder Part and Winding-Side Cylinder Part]

Configurations around the paying-out-side cylinder part 277 and the winding-side cylinder part 279 will be further described on the basis of FIGS. 9 and 10. Here, a guide imaginary line 325 connecting the winding-side cylinder part 279 and the second ribbon guide 283 to each other when seen from the front side in the installation direction is assumed. More specifically, the guide imaginary line 325 is an imaginary line connecting the spot of the winding-side cylinder part 279 with which the second ink ribbon 213 comes into contact and the spot of the second ribbon guide 283 with which the second ink ribbon 213 comes into contact to each other when seen from the front side in the installation direction. The first ribbon guide 281 is provided on the inner side of the second ribbon cartridge 200 with respect to the guide imaginary line 325 when seen from the front side in the installation direction. For this reason, the second ink ribbon 213 is fed on the inner side of the ribbon cartridge 200 with respect to the guide imaginary line 325 between the winding-side cylinder part 279 and the second ribbon guide 283.

Further, an inter-cylinder imaginary line 327 connecting the paying-out-side cylinder part 277 and the winding-side cylinder part 279 to each other when seen from the front side in the installation direction is assumed. More specifically, the inter-cylinder imaginary line 327 is an imaginary line connecting the center of the paying-out-side cylinder part 277 and the center of the winding-side cylinder part 279 to each other when seen from the front side in the installation direction. The second ink ribbon 213 fed from the second paying-out core 205 to the second ribbon exposed part 221 passes through one side of the inter-cylinder imaginary line 327 when seen from the front side in the installation direction. The second ink ribbon 213 fed from the second ribbon exposed part 221 to the second winding core 207 passes through the other side of the inter-cylinder imaginary line 327 when seen from the front side in the installation direction. The first ribbon guide 281 is provided on the downstream side of the winding-side cylinder part 279 in the feeding direction of the second ink ribbon 213 so as to face a closing part 329 that will be described later.

Between the paying-out-side cylinder part 277 and the winding-side cylinder part 279, the closing part 329 that closes the space between the paying-out-side cylinder part 277 and the winding-side cylinder part 279 is provided. The closing part 329 is formed to be integrated with the paying-out-side cylinder part 277 and the winding-side cylinder part 279 over a substantially entire region from the back side in the installation direction to the front side in the installation direction so as to overlap the inter-cylinder imaginary line 327 when seen from the front side in the installation direction. The closing part 329 is only required to be capable of closing the space between the paying-out-side cylinder part 277 and the winding-side cylinder part 279, may not overlap the inter-cylinder imaginary line 327 when seen from the front side in the installation direction, or may be constituted by a material different from those of the paying-out-side cylinder part 277 and the winding-side cylinder part 279. In addition, a cylinder protrusion part 331 protruding from the peripheral surface toward the second ink ribbon 213 on the downstream side of the first ribbon guide 281 in the feeding direction is provided on the paying-out-side cylinder part 277. The cylinder protrusion part 331 extends in the axial direction of the paying-out-side cylinder part 277 and is provided over the substantially entire region of the paying-out-side cylinder part 277 in the axial direction. Further, the cylinder protrusion part 331 is preferably formed to have a protrusion amount to a greater extent within a range in which the cylinder protrusion part 331 does not contact the second ink ribbon 213.

As described above, the first guide body 289 of the first ribbon guide 281 is in contact with the ink surface 213*a* of the second ink ribbon 213. For this reason, there is a likelihood that a residue is generated from the second ink ribbon 213 due to the friction between the ink surface 213*a* of the second ink ribbon 213 and the peripheral surface of the first guide body 289 when the second ink ribbon 213 is fed. When the generated residue of the ribbon is scattered inside the second cartridge case 209, the residue of the ribbon adheres to the second ink ribbon 213 fed from the second paying-out core 205 to the second ribbon exposed part 221 and then adheres to the thermal head 27. As a result, there is a likelihood that a printing failure such as blurring and streaking occurs in a printed image.

In order to address this, the closing part 329 is provided between the paying-out-side cylinder part 277 and the winding-side cylinder part 279, whereby a residue of the ribbon can be prevented from passing through between the paying-out-side cylinder part 277 and the winding-side cylinder part 279 and adhering to the second ink ribbon 213 in the present embodiment. Further, the cylinder protrusion part 331 is provided on the paying-out-side cylinder part 277, whereby a residue of the ribbon can be prevented from adhering to the second ink ribbon 213 from the +X side of the paying-out-side cylinder part 277. In other words, the first ribbon guide 281 that is in contact with the ink surface 213*a* of the second ink ribbon 213 is surrounded by the winding-side cylinder part 279, the closing part 329, the paying-out-side cylinder part 277, and the cylinder protrusion part 331, whereby a catching region for catching a residue of the ribbon generated at the first ribbon guide 281 can be formed. As a result, the occurrence of a printing failure such as blurring and streaking can be prevented. Note that the height, that is, the size of the closing part 329 in the installation direction is substantially the same as the height of the paying-out-side cylinder part 277 or the height of the winding-side cylinder part 279 but is not limited to the height. That is, the height of the closing part 329 may be lower or higher than the height of the paying-out-side cylinder part 277 or the height of the winding-side cylinder part 279.

As shown in FIGS. 10 and 11, a paying-out-side inclination part 333 and a paying-out-side perpendicular part 335 are provided in the circumferential direction of the paying-out-side cylinder part 277 on the peripheral surface of the paying-out-side cylinder part 277. That is, in FIGS. 10 and 11, a portion expressed by relatively thicker lines, specifically, the double lines of a contour line expressing the end on the front side of the paying-out-side cylinder part 277 in the installation direction and a contour line expressing the end on the back side in the installation direction among the contour lines of the paying-out-side cylinder part 277 is the paying-out-side inclination part 333, and a portion expressed by a relatively thinner line among the contour lines of the paying-out-side cylinder part 277 is the paying-out-side perpendicular part 335.

The paying-out-side inclination part 333 is inclined to the central side of the paying-out-side cylinder part 277 with respect to the back-side wall part 269 toward the front side in the installation direction when seen from the front side in the installation direction. The paying-out-side perpendicular part 335 is substantially perpendicular to the back-side wall part 269. That is, an inclination angle at which the paying-out-side perpendicular part 335 is inclined with respect to an angle perpendicular to the back-side wall part 269 is smaller than an inclination angle at which the paying-out-side inclination part 333 is inclined with respect to the angle perpendicular to the back-side wall part 269. Note that the inclination angle of the paying-out-side perpendicular part 335 may be zero. That is, the paying-out-side perpendicular part 335 is not inclined with respect to the angle perpendicular to the back-side wall part 269 or may be perpendicular to the back-side wall part 269. Note that the back-side wall part 269 is an example of the "cylinder protrusion wall part" of the present invention.

The paying-out-side cylinder part 277 guides the second ink ribbon 213 at the paying-out-side perpendicular part 335. For this reason, the second ink ribbon 213 is guided so as to be fed in a state in which the width direction of the second ink ribbon 213 becomes substantially parallel to the rotation shaft of the second paying-out core 205 between the second paying-out core 205 and the second ribbon exposed part 221. As a result, the occurrence of wrinkles in the second ink ribbon 213 can be prevented. Further, since the paying-out-side inclination part 333 is provided on the paying-out-side cylinder part 277, the back-side case 229 can be properly die-cut during its molding.

Like the paying-out-side cylinder part 277, a winding-side inclination part 337 and a winding-side perpendicular part 339 are provided in the circumferential direction of the winding-side cylinder part 279 on the peripheral surface of the winding-side cylinder part 279. That is, in FIGS. 10 and 11, a portion expressed by relatively thicker lines, specifically, the double lines of a contour line expressing the end on the front side of the winding-side cylinder part 279 in the installation direction and a contour line expressing the end on the back side in the installation direction among the contour lines of the winding-side cylinder part 279 is the winding-side inclination part 337, and a portion expressed by a relatively thinner line among the contour lines of the winding-side cylinder part 279 is the winding-side perpendicular part 339.

The winding-side inclination part 337 is inclined to the central side of the winding-side cylinder part 279 with respect to the back-side wall part 269 toward the front side in the installation direction when seen from the front side in the installation direction. The winding-side perpendicular part 339 is substantially perpendicular to the back-side wall part 269. That is, an inclination angle at which the winding-side perpendicular part 339 is inclined with respect to an angle perpendicular to the back-side wall part 269 is smaller than an inclination angle at which the winding-side inclination part 337 is inclined with respect to the angle perpendicular to the back-side wall part 269. Note that the inclination angle of the winding-side perpendicular part 339 may be zero. That is, the winding-side perpendicular part 339 is not inclined with respect to the angle perpendicular to the back-side wall part 269 or may be perpendicular to the back-side wall part 269.

The winding-side cylinder part 279 guides the second ink ribbon 213 at the winding-side perpendicular part 339. For this reason, the second ink ribbon 213 is guided so as to be fed in a state in which the width direction of the second ink ribbon 213 becomes substantially parallel to the rotation shaft of the second winding core 207 between the second ribbon exposed part 221 and the second winding core 207. As a result, the occurrence of wrinkles in the second ink ribbon 213 can be prevented. Further, since the winding-side inclination part 337 is provided on the winding-side cylinder part 279, the back-side case 229 can be properly die-cut during its molding. Note that an angle covered by the winding-side perpendicular part 339 in the circumferential direction of the winding-side cylinder part 279 is not particularly limited. However, the angle is preferably small to such an extent that the second ink ribbon 213 can be properly guided since an angle covered by the winding-side inclination part 337 becomes large correspondingly and die-cut can be properly performed.

As described above, the ribbon cartridge 200 of the present embodiment includes the second winding core 207, the winding-side cylinder part 279, the first ribbon guide 281, and the second ribbon guide 283. The winding-side cylinder part 279 guides the second ink ribbon 213, and the first winding shaft 31 is inserted into the winding-side cylinder part 279 when the ribbon cartridge 200 is installed in the second cartridge installation part 7. The first ribbon guide 281 guides the second ink ribbon 213 at a position closer to the downstream side in the feeding direction than the winding-side cylinder part 279. The second ribbon guide 283 guides the second ink ribbon 213 at a position closer to the downstream side in the feeding direction than the first ribbon guide 281. The first ribbon guide 281 is provided on the inner side of the ribbon cartridge 200 with respect to the guide imaginary line 325 connecting the winding-side cylinder part 279 and the second ribbon guide 283 to each other when seen from the front side in the installation direction.

According to the configuration, the second ink ribbon 213 is fed on the inner side of the ribbon cartridge 200 with respect to the guide imaginary line 325 connecting the winding-side cylinder part 279 and the second ribbon guide 283 to each other between the winding-side cylinder part 279 and the second ribbon guide 283. As a result, the ribbon cartridge 200 can be downsized in comparison with a configuration in which the second ribbon guide 283 is fed on the guide imaginary line 325.

Modified Examples

Needless to say, the present invention is not limited to the above embodiment but is capable of employing various configurations without departing from its spirit. For example, the above embodiment can be modified into the following modes.

On the downstream side of the winding-side cylinder part 279 in the feeding direction and on the upstream side of the first ribbon guide 281 in the feeding direction, a third ribbon guide may be provided. Further, the third ribbon guide may be provided on the outer side of the ribbon cartridge 200 with respect to the guide imaginary line 325 when seen from the front side in the installation direction. At this time, the second ink ribbon 213 fed from the second ribbon exposed part 221 to the second winding core 207 may be fed to the side of the first ribbon guide after contacting the third ribbon guide without contacting the winding-side cylinder part 279.

The winding-side cylinder part 279 may guide the second ink ribbon 213 fed from the second ribbon exposed part 221 to the second winding core 207 by causing the same to contact a part on the +Y side of its peripheral surface. At this time, there is a likelihood that a residue of the ribbon is generated at the winding-side cylinder part 279 due to the contact between the winding-side cylinder part 279 and the ink surface 213*a* of the second ink ribbon 213. Therefore, the closing part 329 may extend from the paying-out-side cylinder part 277 toward the space between the second ink ribbon 213 fed from the paying-out-side cylinder part 277 to the second ribbon exposed part 221 and the winding-side cylinder part 279.

The first ribbon guide 281 is not necessarily formed to be integrated with the back-side wall part 269. The first ribbon guide 281 may be formed into, for example, a cylindrical columnar shape and configured to be rotatable with respect to the back-side wall part 269. According to the configuration, the friction between the peripheral surface of the first ribbon guide 281 and the ink surface 213*a* of the second ink ribbon 213 reduces since the first ribbon guide 281 rotates with the feeding of the second ink ribbon 213. As a result, a residue generated from the second ink ribbon 213 in the first ribbon guide 281 can be reduced.

The "first ribbon cartridge" of the present invention is not limited to a configuration in which a printing medium such as the first tape 111 is accommodated like the tape cartridge 100 of the present embodiment but may have a configuration in which a printing medium is not accommodated. Similarly, the "second ribbon cartridge" of the present invention is not limited to a configuration in which a printing medium is not accommodated like the ribbon cartridge 200 of the present embodiment but may have a configuration in which a printing medium is accommodated.

The tape printing device P may have a configuration in which the first paying-out shaft 29 is not provided. In this case, the ribbon cartridge 200 may not include the paying-out-side cylinder part 277. Further, the tape printing device P may have a configuration in which the second paying-out shaft 45 is not provided.

A printing device in which the ribbon cartridge 200 is installed is not limited to a configuration that performs printing on a tape-shaped printing medium such as the first tape 111 and the second tape 500. That is, the "printing device" of the present invention may perform printing on, for example, a roll sheet or a sheet.

Figure 12:
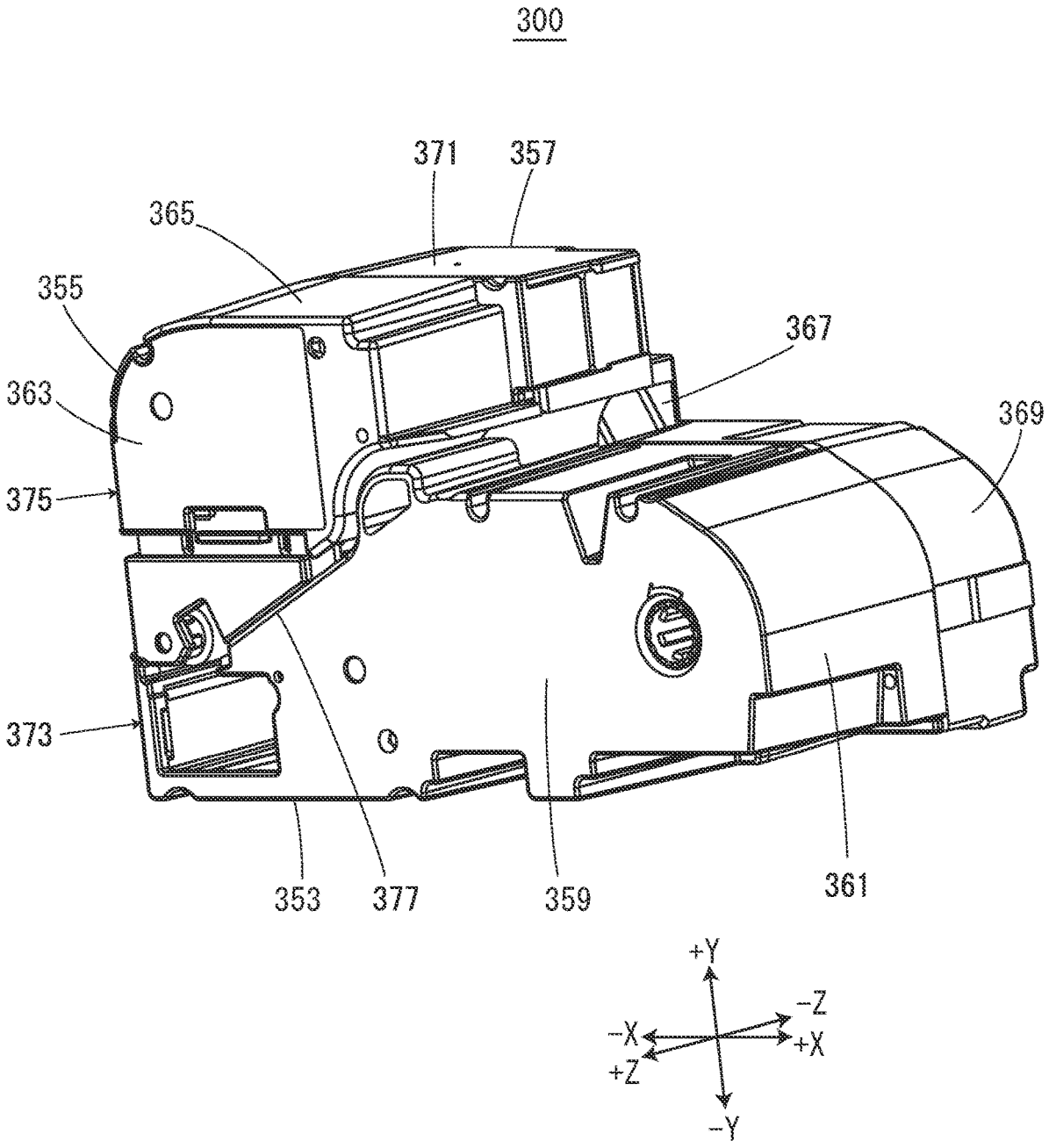
FIG. 12 is a perspective view of a ribbon cartridge according to a modified example.

As shown in FIG. 12, a ribbon cartridge 300 of a modified example includes a ribbon-part front-side case 353, a roller-part front-side case 355, and a common back-side case 357. The ribbon-part front-side case 353 includes a ribbon-part front-side wall part 359 and a ribbon-part front-side peripheral wall part 361 protruding to the back side in the installation direction from the peripheral edge part of the ribbon-part front-side wall part 359. The roller-part front-side case 355 includes a roller-part front-side wall part 363 and a roller-part front-side peripheral wall part 365 protruding to the back side in the installation direction from the peripheral edge part of the roller-part front-side wall part 363. The common back-side case 357 includes a common back wall part 367 and a ribbon-part back-side peripheral wall part 369 and a roller-part back-side peripheral wall part 371 protruding to the front side in the installation direction from the common back wall part 367.

The ribbon-part front-side case 353 and the common back-side case 357 are combined together so as to make the ribbon-part front-side peripheral wall part 361 and the ribbon-part back-side peripheral wall part 369 face each other, and constitute the outer shell of an ink ribbon accommodation part 373. The ink ribbon accommodation part 373 is configured to be substantially the same as the ribbon cartridge 200 of the embodiment. The roller-part front-side case 355 and the common back-side case 357 are combined together so as to make the roller-part front-side peripheral wall part 365 and the roller-part back-side peripheral wall part 371 face each other, and constitute the outer shell of a roller accommodation part 375. The roller accommodation part 375 rotatably supports and accommodates a platen roller like the second platen roller 403 and is configured to be substantially the same as the tape guide 400 of the embodiment. The ink ribbon accommodation part 373 and the roller accommodation part 375 are integrally formed via the common back wall part 367. That is, the ribbon cartridge 300 is one in which the ink ribbon accommodation part 373 corresponding to the ribbon cartridge 200 of the embodiment and the roller accommodation part 375 corresponding to the tape guide 400 of the embodiment are integrated with each other. Further, a second tape path 377 to which the second tape 500 introduced from the outside of the device case 1 is fed is provided between the ribbon-part front-side case 353 and the roller-part front-side case 355.

EXPLANATION OF REFERENCE SYMBOLS

200: ribbon cartridge
205: second paying-out core
207: second winding core
213: second ink ribbon
213*a*: ink surface
217: second ribbon core accommodation part
219: second head insertion part
221: second ribbon exposed part
229: back-side case
269: back-side wall part
271: second peripheral wall part
277: paying-out-side cylinder part
279: winding-side cylinder part
281: first ribbon guide
283: second ribbon guide
285: reception insertion part
287: press-fitting hole
289: first guide body
291: first guide rib
293: second guide body
295: second guide rib
297: reception insertion hole
299: back-side first wall part
301: back-side second wall part
303: back-side third wall part
305: back-side fourth wall part
307: back-side peripheral wall recessed part
309: substrate attachment part
311: circuit substrate
313: peripheral wall protrusion part
315: back-side first portion wall part
317: back-side second portion wall part
319: back-side third portion wall part
325: guide imaginary line
327: inter-cylinder imaginary line
329: closing part
331: cylinder protrusion part
333: paying-out-side inclination part
335: paying-out-side perpendicular part
337: winding-side inclination part
339: winding-side perpendicular part

The invention claimed is:

1. A ribbon cartridge that is a second ribbon cartridge installed in a printing device including a first cartridge installation part in which a first ribbon cartridge accommodating a first paying-out core on which the first ink ribbon is wound and a first winding core on which the first ink ribbon fed from the first paying-out core is wound is installed, a second cartridge installation part in which the second ribbon cartridge accommodating a second paying-out core on which a second ink ribbon is wound and a second winding core on which the second ink ribbon fed from the second paying out core is wound is installed, a first paying-out shaft that is provided in an overlap region of the first cartridge installation part and the second cartridge installation part and inserted into the first paying-out core when the first ribbon cartridge is installed in the first cartridge installation part, and a first winding shaft that is provided in the overlap region and inserted into the first winding core when the first ribbon cartridge is installed in the first cartridge installation part, the ribbon cartridge comprising:

a winding-side inserted part into which the first winding shaft is inserted when the second ribbon cartridge is installed in the second cartridge installation part.

2. The ribbon cartridge according to claim 1, comprising:

a paying-out-side inserted part into which the first paying-out shaft is inserted when the second ribbon cartridge is installed in the second cartridge installation part.

3. The ribbon cartridge according to claim 2, comprising:

a roller accommodation part that accommodates a platen roller; and a second ribbon exposed part at which the second ink ribbon is exposed so that a thermal head provided in the overlap region is capable of contacting the second ink ribbon between the thermal head and the platen roller when the second ribbon cartridge is installed in the second cartridge installation part, wherein the second ink ribbon fed to the second ribbon exposed part passes through one side of an inter-inserted part imaginary line connecting the paying-out-side inserted part and the winding-side inserted part to each other when seen from the front side in the installation direction, and the second ink ribbon fed from the second ribbon exposed part passes through the other side of the inter-inserted part imaginary line on a side opposite to the one side of the inter-inserted part imaginary line when seen from the front side in the installation direction.

4. The ribbon cartridge according to claim 3, comprising:

a second head insertion part into which the thermal head is inserted when the second ribbon cartridge is installed in the second cartridge installation part; and a second ribbon core accommodation part that rotatably accommodates the second paying-out core and the second winding core, wherein the paying-out-side inserted part and the winding-side inserted part are provided between the second ribbon core accommodation part and the second head insertion part.

5. The ribbon cartridge according to claim 4, comprising:

a first case and a second case that constitute an outer shell of the second ribbon core accommodation part; and a third case that is combined with the first case and the second case, and constitutes an outer shell of the roller accommodation part, wherein the winding-side inserted part and the paying-out-side inserted part are provided in one of the first case and the second case.

6. The ribbon cartridge according to claim 2, wherein the paying-out-side inserted part guides the feeding of the second ink ribbon.

7. The ribbon cartridge according to claim 6, wherein the paying-out-side inserted part has a cylindrical shape, an elliptic cylindrical shape, a semi-cylindrical shape, or a square tube shape.

8. The ribbon cartridge according to claim 1, wherein the winding-side inserted part guides the feeding of the second ink ribbon.

9. The ribbon cartridge according to claim 8, wherein the winding-side inserted part has a cylindrical shape, an elliptic cylindrical shape, a semi-cylindrical shape, or a square tube shape.

* * * * *